US012082715B2

(12) United States Patent
Lin et al.

(10) Patent No.: US 12,082,715 B2
(45) Date of Patent: Sep. 10, 2024

(54) WALL MOUNTING SYSTEM

(71) Applicant: Display Your Passion Like a Boss, Las Cruces, NM (US)

(72) Inventors: James Y. Lin, Las Cruces, NM (US); Kevin C. Lin, Las Cruces, NM (US)

(73) Assignee: Display Your Passion Like a Boss, Las Cruces, NM (US)

( * ) Notice: Subject to any disclaimer, the term of this patent is extended or adjusted under 35 U.S.C. 154(b) by 210 days.

(21) Appl. No.: 17/893,812

(22) Filed: Aug. 23, 2022

(65) Prior Publication Data

US 2024/0065455 A1 Feb. 29, 2024

(51) Int. Cl.
*A47F 3/00* (2006.01)

(52) U.S. Cl.
CPC ..... *A47F 3/004* (2013.01); *A47F 3/001* (2013.01)

(58) Field of Classification Search
CPC ..... A47F 3/004; A47F 3/001; A47F 3/00
See application file for complete search history.

(56) References Cited

U.S. PATENT DOCUMENTS 10,194,759 B1 * 2/2019 Didur ..... F21V 23/003
11,937,711 B1 * 3/2024 Reynolds, Jr. ..... A47F 3/001
2006/0181180 A1 * 8/2006 McCabe ..... A47F 3/001 312/114
2014/0340879 A1 * 11/2014 Liu ..... A47F 3/001 362/125
2016/0000236 A1 * 1/2016 Goppion ..... E05D 15/56 312/138.1
2016/0367047 A1 * 12/2016 Neelagantan ..... A47F 3/04
2017/0181539 A1 * 6/2017 Linden ..... A47F 3/004
2019/0391405 A1 * 12/2019 Takechi ..... G03B 21/28
2020/0329868 A1 * 10/2020 Mølgaard ..... A47F 3/001
2023/0184485 A1 * 6/2023 Baugh ..... F25D 23/02 348/61
2023/0276939 A1 * 9/2023 Clark ..... A47B 47/005 220/4.28

* cited by examiner

*Primary Examiner* — Amy J. Sterling
(74) *Attorney, Agent, or Firm* — Briggs IP; Jeremy A. Briggs

(57) ABSTRACT

A wall mounting system having a wall mountable bracket cleat having an upper rear cleat surface slanted at a first predetermined angle. The wall mounting system further includes a wall anchor module configured to removably attach to the wall mountable bracket cleat. The wall anchor module includes a pivot connector socket and a locking surface on a wall anchor module side. The pivot connector socket movably attaches to a battery storage compartment, and the locking surface locks the battery storage compartment. The wall anchor module further includes an anchor recess having an upper anchor recess surface configured to engage with the upper rear cleat surface. The anchor recess is formed at a wall anchor module rear surface, and the upper anchor recess portion is slanted at the first predetermined angle. The wall anchor module further includes an attachment configured to attach the wall anchor module to a display plate.

20 Claims, 23 Drawing Sheets

SECTION VIEW B-B

WALL MOUNTING SYSTEM

BACKGROUND

Those that build intricate models may wish to display their model in a display case fixture that highlights the details of their work. Although display cases, shadow boxes, and cabinets may provide a storage area for intricate models, conventional displays do not provide customization that accommodates models of various sizes, or multiple models arranged in a themed environment that can be changed from model to model.

For example, the one display case or shelf may not fit the footprint of some models or accommodate expansion of the display for larger displayed works.

In other aspects, conventional model display systems do not provide exchangeable features that can accentuate the modeled item such as lighting or architectural features that match the model theme. Moreover, when the display case is to be hung on a wall, conventional means for mounting the display do not provide ease of removal off of the wall, or when the display is removable, the attaching mechanism does not provide a high degree of stability in the attachment.

It is with respect to these and other considerations that the disclosure made herein is presented.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Overview

Figure 1:
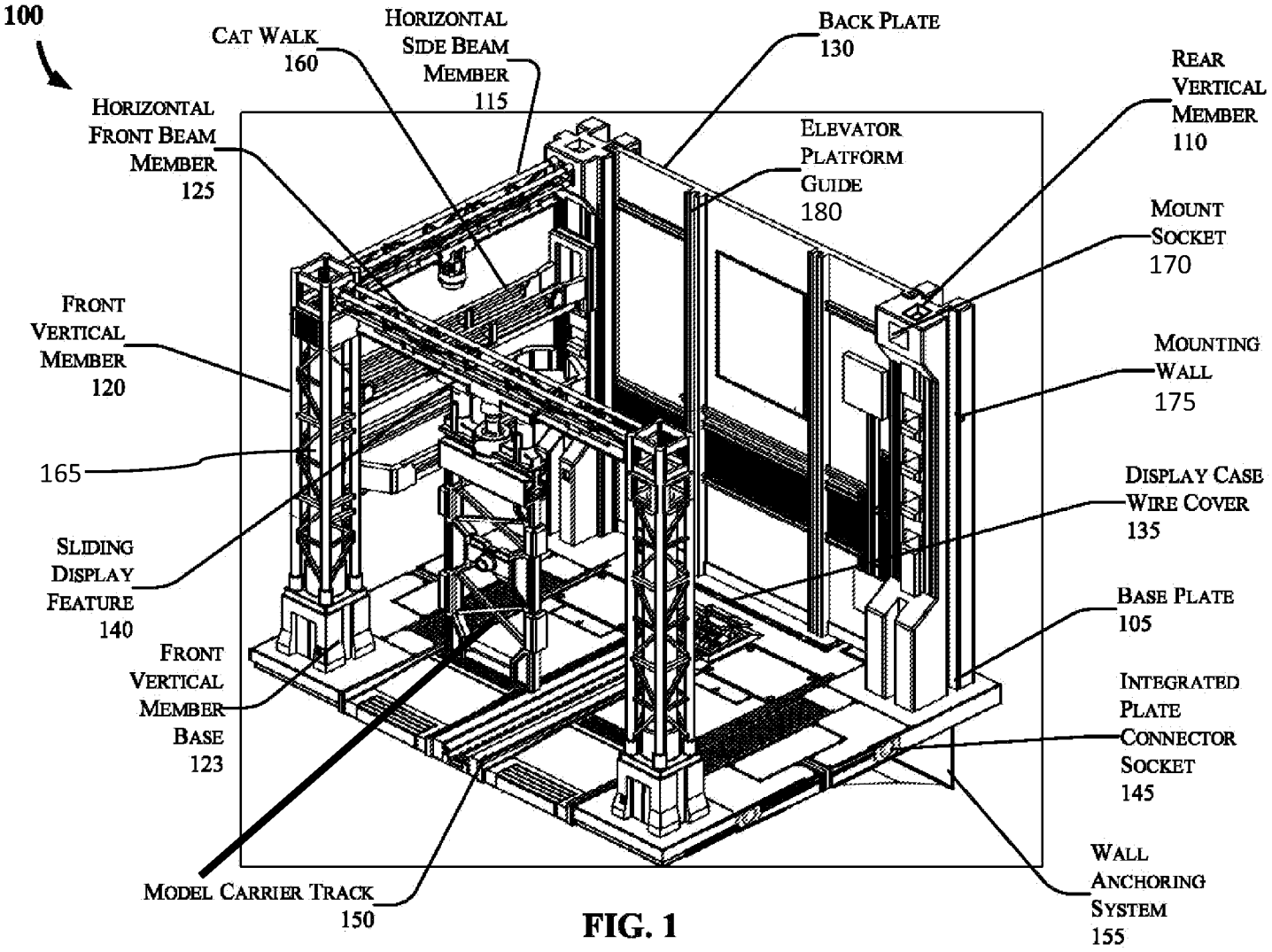
FIG. 1 depicts an example customizable wall-mounted display case system in accordance with embodiments of the present disclosure.

The systems and methods disclosed herein are configured to display items such as models, figures, memorabilia, or any object in a display case that has infinite configurability for size and design that can match a theme of the object being displayed. For example, if the model being displayed is a robot or fictional character, the environment of the display case may be customizable to fit the theme of the object being displayed by interchanging structural display system parts with parts having compatible connectivity. In other aspects, a model may be larger than a size that a single display set can accommodate. In some embodiments, multiple sets of the same system may be connected together to create a custom sized display module.

Embodiments described herein can include features that allow the display to be securely hung on a vertical wall, yet easily removable by lifting the display vertically then away from the wall mount features.

According to one embodiment, the modular wall display system includes basic structure components that can include a base plate, front and rear vertical members that connect with the base plate, and side members that add structure and stability to the display system. All parts connect together in a removable fashion such that features having a particular theme can be customized according to the taste and availability of themed parts. For example, a vehicle themed display may include vertical members and a back plate that provide the look and feel of an automotive garage. In another example, the vertical members and back plate may have features that resemble a sports stadium for displaying sports memorabilia.

In other aspects, it is advantageous to provide a custom mounting bracket system that provides stable wall hanging features while allowing for customization of size and design features.

Because displayable models and objects can take various shapes and forms, embodiments of the present disclosure may include expansion features that allow display sets to be combined to form a unified display having infinite configurability and size. For example, three or four sets may be combined to create a display set that is wall-hangable and long enough to display a baseball bat. In another example, the display system may also expand vertically by adding a second display surface that is directly above the main display surface and removably attachable to a top surface of the vertical members of the lower display system.

Embodiments of the present disclosure may provide for flexibility in size, design, and configuration while allowing display of objects on a wall or flat surface in a way that provides stable and creative customizations while providing convenient interchangeability of structural and design parts.

These and other advantages of the present disclosure are provided in greater detail herein.

Illustrative Embodiments

The disclosure will be described more fully hereinafter with reference to the accompanying drawings, in which example embodiments of the disclosure are shown, and not intended to be limiting.

FIG. 1 depicts an example customizable wall-mounted display case system 100 in accordance with embodiments of the present disclosure. The wall-mounted display case system 100 may include a base plate 105 having a model display surface on a proximal base plate side, on which a display item may be placed. The display item may include, for example, models, figures, memorabilia, and/or the like. The base plate 105 may further include a display mounting surface on a distal base plate side. In some aspects, the model display surface may be opposite to the display mounting surface.

In some aspects, the base plate 105 may be made of plastic or metals such as aluminum, steel, and/or the like. Further, the base plate 105 may be square or rectangular in shape, as shown in FIG. 1. In other aspects, the base plate 105 may be circular, oval, or of any other shape. Further, base plate dimensions may vary based on wall-mounted display case system dimensions, and a base plate width may be dependent on a type of display item that may be placed on the wall-mounted display case system 100. For example, if the wall-mounted display case system 100 is configured to display a heavy item, the base plate width may be thick.

The wall-mounted display case system 100 may further include a rear vertical member set that may be removably disposed on the proximal base plate side. In particular, the rear vertical member set may include first and second rear vertical members 110, which may be removably connected/disposed on the proximal base plate side. In some aspects, the first and second rear vertical members 110 may be disposed at two proximal base plate side rear corners (e.g., proximal base plate side left and right rear corners). In some aspects, the first rear vertical member 110 may be same as the second rear vertical member 110. For example, first rear vertical member attributes (such as structure, material, features, etc.) may be same as second rear vertical member attributes. In one or more aspects, the first and second rear vertical members 110 may be made of plastic. In other aspects, the first and second rear vertical members 110 may be made of same material as the base plate 105.

The wall-mounted display case system 100 may further include a horizontal side beam member set that may be removably disposed in connection with the first and second rear vertical members 110, and a front vertical member set. In some aspects, The horizontal side beam member set may include a first horizontal side beam member 115 and a second horizontal side beam member (not shown in FIG. 1) that may be removably disposed with respective the front vertical member set and the rear vertical member set. In some aspects, the front vertical member set may include first and second front vertical members 120, and the first and second front vertical members 120 may be removably connected to the proximal base plate side.

In some aspects, the horizontal side beam member set may removably dispose perpendicularly between the rear vertical member set and the front vertical member set. The horizontal side beam member set may provide rigidity and stability to the wall-mounted display case system 100, and prevents the wall-mounted display case system 100 (specifically, the base plate 105) from collapsing if a heavy display item is placed on the base plate 105. In addition, the horizontal side beam member set may be used to couple with wall-mounted display case system accessories (e.g., lighting accessories, audio accessories, ornamental accessories, and/or the like).

In some aspects, the first and second front vertical members 120 may have same attributes (such as structure, material, features etc.) as the first and second rear vertical members 110 attributes. In further aspects, the first and second front vertical members 120 may include a front vertical member upright body portion 165 and a front vertical member base 123. Specifically, each of the first and second front vertical members 120 may include respective front vertical member upright body portions and front vertical member bases. The front vertical member upright body portion 165 may be removably connected to the front vertical member base 123. Further, the front vertical member base 123 may be removably connected to the base plate 105, which removably connects the first and second front vertical members 120 to the base plate 105.

In some aspects, a front vertical member base height and a front vertical member upright body portion height may be customizable (e.g., the height can be increased or decreased), so that a wall-mounted display case system height may be customized. The customizable height may enable a user to display items of varying sizes in the wall-mounted display case system 100.

The wall-mounted display case system 100 may further include a horizontal front beam member 125 that may be removably disposed in connection between the first and second front vertical members 120. In some aspects, the horizontal front beam member 125 may provide rigidity and stability to the first and second front vertical members 120. In other aspects, the horizontal front beam member 125 may be used to couple with the wall-mounted display case system accessories.

In one or more aspects, the horizontal front beam member 125 may have same attributes (e.g., dimensions, material, features, and/or the like) as the horizontal side beam member set attributes. In other aspects, the horizontal front beam member 125 may have different attributes from the horizontal side beam member set attributes. Furthermore, in some aspects, a horizontal front beam member length may depend on the wall-mounted display case system dimensions. For example, if the wall-mounted display case system 100 is configured to place display items of long lengths, the horizontal front beam member length too may be long (and vice-versa).

In accordance with some aspects, each rear vertical member (i.e., the first and second rear vertical members 110) may include a set of slots (not shown) to removably connect a back plate 130 between the rear vertical member set. In particular, each of the first and second rear vertical members 110 may include an inside back plate expansion slot and an outside back plate expansion slot, and the back plate 130 may be removably connected to the rear vertical member set via the inside back plate expansion slot and/or the outside back plate expansion slot. The rear vertical member structural details (e.g., the first and second rear vertical member structural details) are described later, in conjunction with FIG. 6.

In some aspects, the back plate 130 may be configured to slide between the first and second rear vertical members 110. The back plate 130 may be customized in structure, color, and/or design to complement the display item that may be placed on the wall-mounted display case system 100. For example, if the wall-mounted display case system 100 is used to display sports memorabilia, the back plate 130 may be designed to have sports-based theme. In this manner, the back plate 130 may highlight the item(s) that may be placed on the wall-mounted display case system 100.

In further aspects, the wall-mounted display case system 100 may include a display case wire cover 135 on the proximal base plate side. In some aspects, the display case wire cover 135 may be a slidable or rotatable cover that may be configured to open and close to receive a wiring arrangement (e.g., wires) from a base plate bottom side (e.g., from the distal base plate side). In one or more aspects, the wires may be connectable with a power source at one end and one or more light emitting diodes (e.g., LEDs, not shown) at another end. The LEDs may be disposed on the wall-mounted display case system 100 and may be used to illuminate or highlight the display item that may be placed on the wall-mounted display case system 100. In further aspects, the wires may be connected to one or more additional accessories (e.g., audio or speaker system) that may be installed in the wall-mounted display case system 100.

The wall-mounted display case system 100 may further include one or more sliding display feature 140 that may be configured to removably attach with wall-mounted display case system accessories (e.g., LEDs, audio system, miniature action figures, model platforms, and/or the like). The sliding display feature 140 may be removably disposed on the horizontal side beam member set, and/or the horizontal front beam member 125. In some aspects, the sliding display feature 140 may include a set of rollers to slide on the horizontal side beam member set and/or the horizontal front beam member 125. Specifically, the sliding display feature 140 may be slidable along an underside portion of the horizontal side beam member set and/or the horizontal front beam member 125 (as shown in FIG. 1). In some aspects, the sliding display feature 140 may be made to slide (or move) automatically by using an actuator (not shown). In other aspects, a wall-mounted display case system user may slide the sliding display feature 140.

In further aspects, the base plate 105 may include one or more integrated plate connector sockets 145 configured to connect the base plate 105 to a second base plate (not shown in FIG. 1), and expand the model display surface associated with the wall-mounted display case system 100. The integrated plate connector sockets 145 may be disposed on a proximal and/or distal base plate edge of the base plate 105 and the second base plate. In other words, the one or more integrated plate connector sockets 145 may allow model display surface customization, and items of varying sizes may be displayed on the wall-mounted display case system 100.

In further aspects, the wall-mounted display case system 100 may include a model carrier track 150 having gear teeth that engage a carrier gear disposed on a carrier platform that travels along the model carrier track 150. The model carrier track 150 may allow the wall-mounted display case system user to removably affix a display item (e.g., a model, an action figure, and the like) on the model carrier track 150 by using the gear teeth, and move the display item from a wall-mounted display case system front side to the back (and vice versa). The arrangement allows the wall-mounted display case system user to affix the display item stably on the model display surface and move the display item forward/backward.

In some aspects, the wall-mounted display case system 100 may be mounted on a wall via a wall anchoring system 155. The wall anchoring system 155 may be disposed to the display mounting surface on the distal base plate side. The wall anchoring system 155 may include a removable locking surface that may be configured to removably attach to a wall mountable bracket cleat set (not shown in FIG. 1).

The wall-mounted display case system 100 may further include a catwalk 160 that may be removably disposed between the first rear vertical member and the first front vertical member. In some aspects, the catwalk 160 may be removably disposed between the second rear vertical member and the second front vertical member (or between any two vertical members). The catwalk 160 may provide additional rigidity and support to the wall-mounted display case system 100, and may be used to place accessories (such as platforms, LEDs etc.). In some aspects, the catwalk 160 may be placed below the horizontal side beam member set and/or horizontal front beam member 125, respectively.

In some aspects, the wall-mounted display case system 100 may include one or more additional components, such as a mount socket 170 and a mounting wall 175 on the rear vertical member (e.g., the first and second rear vertical members 110), and an elevator platform guide 180. The mount socket 170 may be configured to removably connect the horizontal side beam member 115 between the front and rear vertical member set (e.g., between the first and second front vertical members 120 and the first and second rear vertical members 110, respectively). The mounting wall 175 may be configured to receive the back plate 130, when the back plate 130 is slid between the first and second rear vertical members 110. Further, the elevator platform guide 180 may be used by the wall-mounted display case system 100 to support or place a model elevator (not shown) on the wall-mounted display case system 100.

Figure 2:
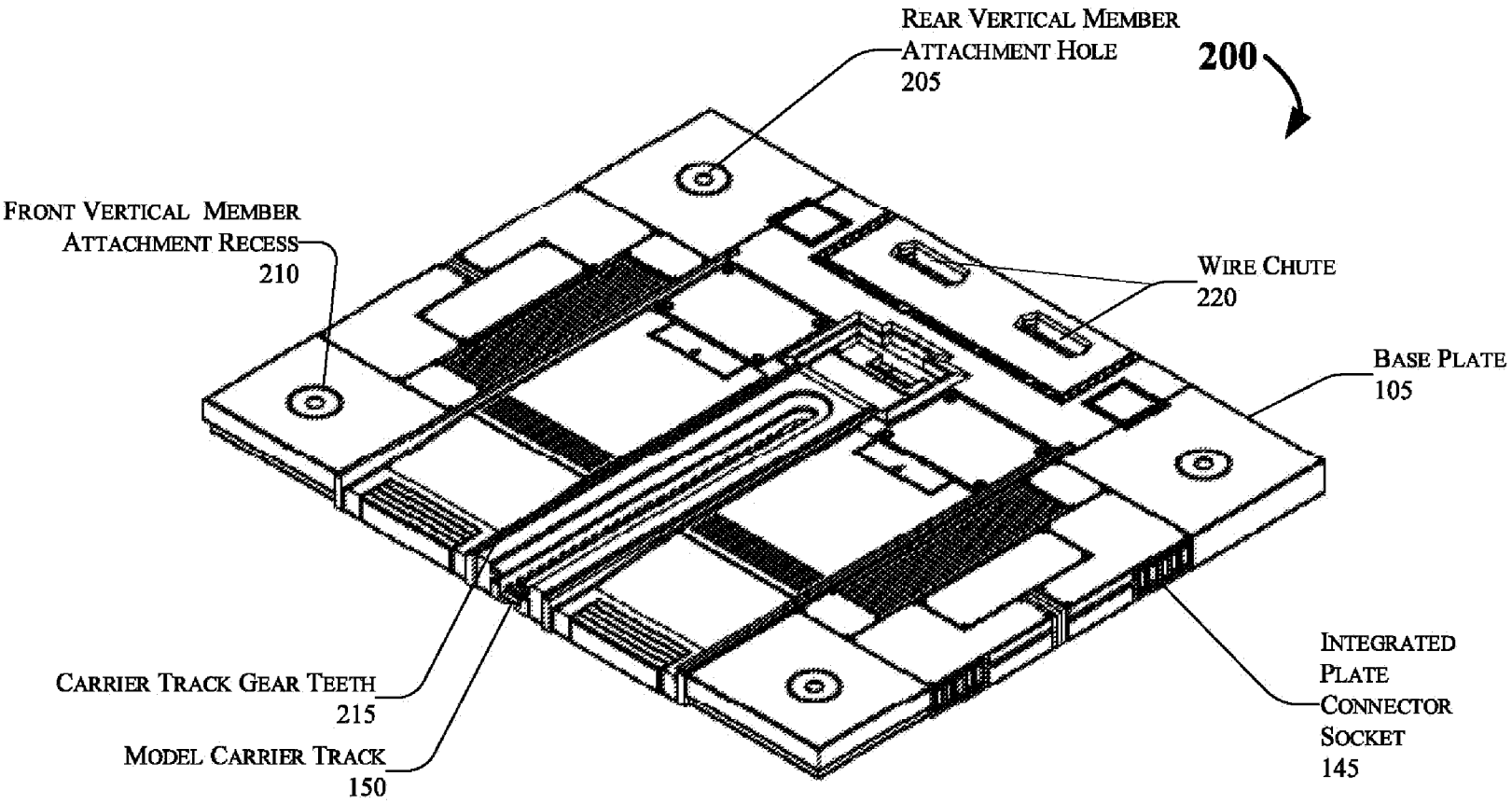
FIG. 2 depicts a display plate in accordance with the present disclosure.

FIG. 2 depicts a display plate 200 in accordance with the present disclosure. In some aspects, the wall-mounted display case system user may display items on the wall-mounted display case system 100 by placing the items on the display plate 200. The display plate 200 may include the base plate 105 described in conjunction with FIG. 1. As described above, the base plate 105 may include the model display surface and the display mounting surface. FIG. 2 depicts the model display surface.

In some aspects, the display plate 200 may include rear vertical member attachment holes (or recesses/cavities) 205 that may be configured to removably connect the rear vertical member set (e.g., the first and second rear vertical members 110). In other words, the display plate 200 may include two rear vertical member attachment holes to removably connect with the first and second rear vertical members 110. The rear vertical member attachment holes' shape and size may correspond to a size and shape of a rear vertical member protrusion (or an extension) that inserts into the rear vertical member attachment holes 205 to connect the first and second rear vertical members 110 to the base plate 105.

In further aspects, the display plate 200 may include front vertical member attachment holes (or recesses/cavities) 210 that may removably connect with the first and second front vertical members 120. Specifically, the display plate 200 may include two front vertical member attachment holes to removably connect with the first and second front vertical members 120. In some aspects, the two front vertical member attachment holes may removably connect with the front vertical member base 123. The shape and size associated with the front vertical member attachment holes 210 may correspond to a size and shape of a front vertical member base protrusion (or an extension) that inserts into the front vertical member attachment holes 210 to connect the first and second front vertical members 120 to the base plate 105.

The display plate 200 may further include the model carrier track 150 described in conjunction with FIG. 1. The model carrier track 150 may include carrier track gear teeth 215. As described above, the model carrier track 150 may allow the wall-mounted display case system user to removably affix the display item(s) on the model carrier track 150 by using the carrier track gear teeth 215, and move the display item from the wall-mounted display case system front side to the back (and vice versa).

The display plate 200 may further include one or more wire chute 220 that may be configured to receive wiring arrangement from the first base plate bottom (e.g., from the distal base plate side). As described above, the wires may be connectable to a power source at one end and one or more light emitting diodes (e.g., LEDs, not shown) or other wall-mounted display case system accessories at the other end. In addition, the display plate 200 may include the integrated plate connector sockets 145 as described in conjunction with FIG. 1.

Figure 3:
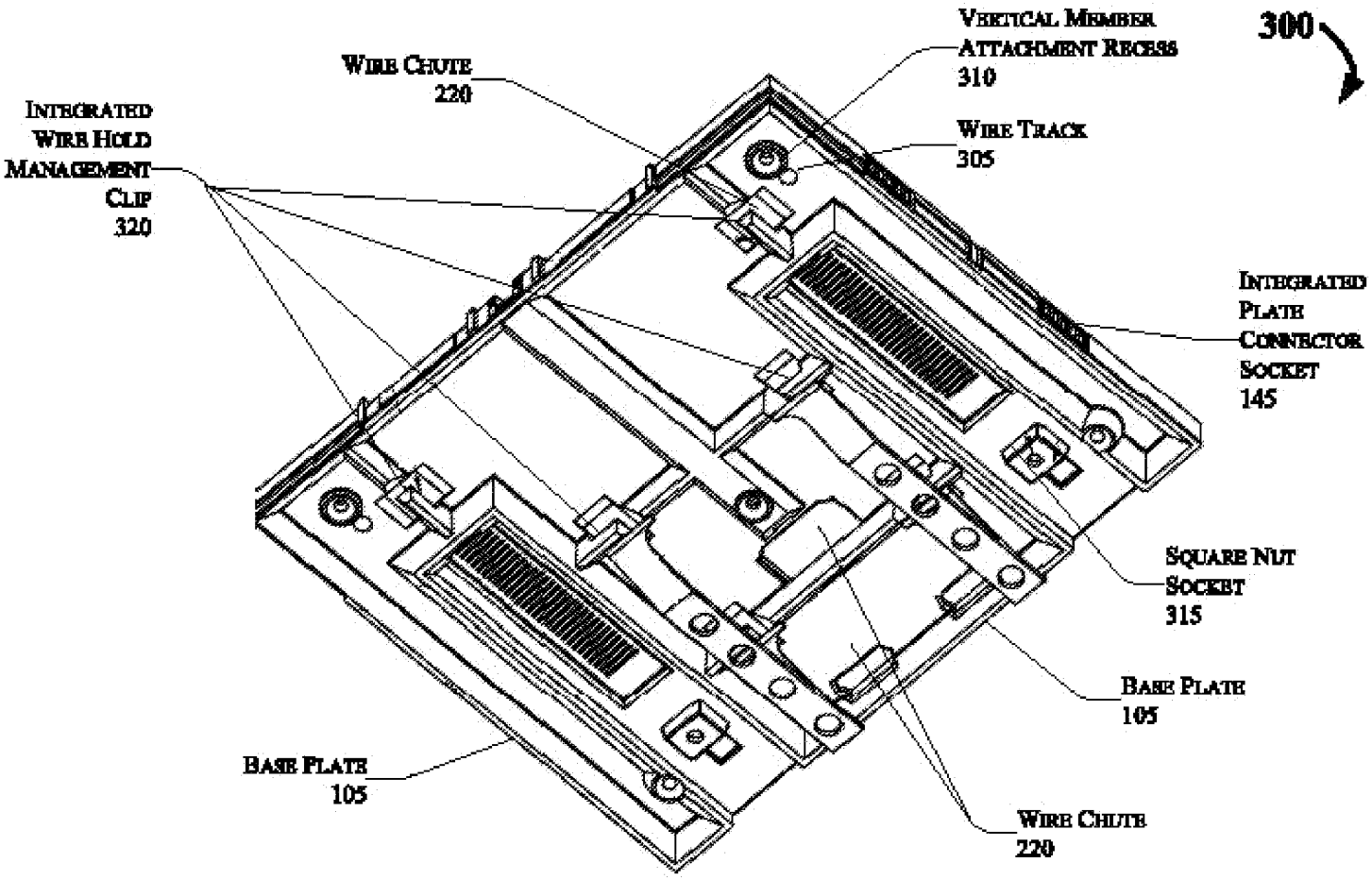
FIG. 3 depicts a bottom view of the display plate of FIG. 2 in accordance with the present disclosure.

FIG. 3 depicts a bottom view of a display plate 300 of FIG. 2 in accordance with the present disclosure. The display plate 300 may be same as the display plate 200. The display plate 300 may include the base plate 105 having the model display surface and the display mounting surface. FIG. 3 depicts the display mounting surface.

The display plate 300 may include one or more wire track set 305 to provide track for the wires from the display mounting surface to the model display surface. For example, if the first and second front vertical members 120 include one or more LEDs (or other accessories) that may require electric power to operate, the wires from the display mounting surface may provide the required power. In this case, the wires may be connected to a power source (not shown in FIG. 3).

The wire track 305 may be arranged near to (or attached to) a vertical member attachment recess 310 that may be configured to engage the first and second rear vertical members 110 and/or the first and second front vertical members 120. In some aspects, the display plate 300 may include two vertical member attachment recesses (and two wire tracks) configured to engage with the first and second front vertical members 120. In other aspects, there may be four vertical member attachment recesses (and four wire tracks) configured to engage with the first and second rear vertical members 110 and the first and second front vertical members 120. In further aspects, the vertical member attachment recess 310 may be same as the front vertical member attachment holes 210 and/or the rear vertical member attachment holes 205, and may depict the holes' bottom view.

The display plate 300 may further include one or more square nut socket 315 that may be located towards a base plate rear end. In some aspects, the square nut socket 315 may be configured to attach with the wall anchoring system 155, which may configure the wall-mounted display case system 100 to mount to a wall.

The display plate 300 may further include a plurality of integrated wire hold management clips 320. The plurality of integrated wire hold management clips 320 is configured to hold the wires in the display plate 300 (specifically, in the display mounting surface), and may be placed at different locations as indicated in FIG. 3. In some aspects, the display plate 300 may include or may be connected to a power source (e.g., a battery, not shown in FIG. 3) that may be configured to provide power to illuminate the wall-mounted display case system LEDs and/or accessories.

In some aspects, the display plate 300 may further include the wire chute 220 and the integrated plate connector sockets 145, as described in conjunction with FIG. 2.

Figure 4:
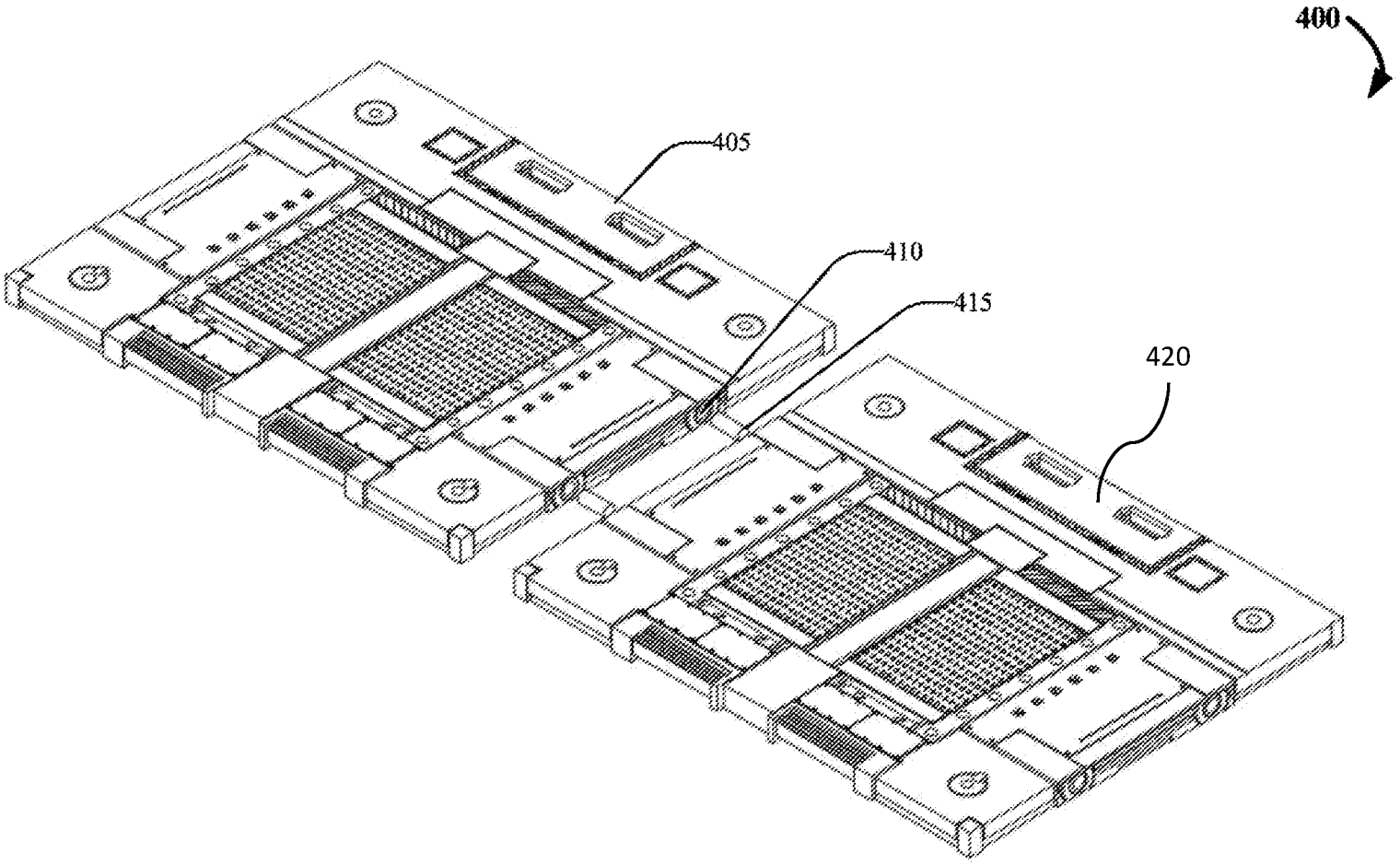
FIG. 4 illustrates a plurality of display plates in accordance with the present disclosure.

FIG. 4 illustrates a plurality of display plates 400 in accordance with the present disclosure. As discussed above, the wall-mounted display case system 100 may be customized based on the display item/model size and type. For instance, the wall-mounted display case system 100 may be expanded horizontally by removably connecting a first display plate 405 with a second display plate 420.

In some aspects, the first display plate 405 may include integrated plate connector sockets 410 that may be disposed on a first base plate proximal and/or distal edge. In some aspects, there may be two integrated plate connector sockets on each proximal or distal base plate edge. Similarly, the second display plate 420 may include integrated plate connector sockets (not shown in FIG. 4) that may be disposed on a second base plate proximal and/or distal edge.

The first display plate 405 and the second display plate 420 may removably connect with each other via a connector/coupler 415. The connector/coupler 415 may be inserted in the integrated plate connector sockets 410 at one end, and corresponding integrated plate connector sockets of the second display plate 420 at another end. In other words, the connector/coupler 415 may be configured to connect the first display plate 405 and the second display plate 420.

In some aspects, the connector/coupler size and shape may correspond to the integrated plate connector sockets' size and shape. For example, the connector/coupler 415 may be cylindrical in shape, and the integrated plate connector sockets 410 may include cylindrical cavities/recesses.

Figure 5:
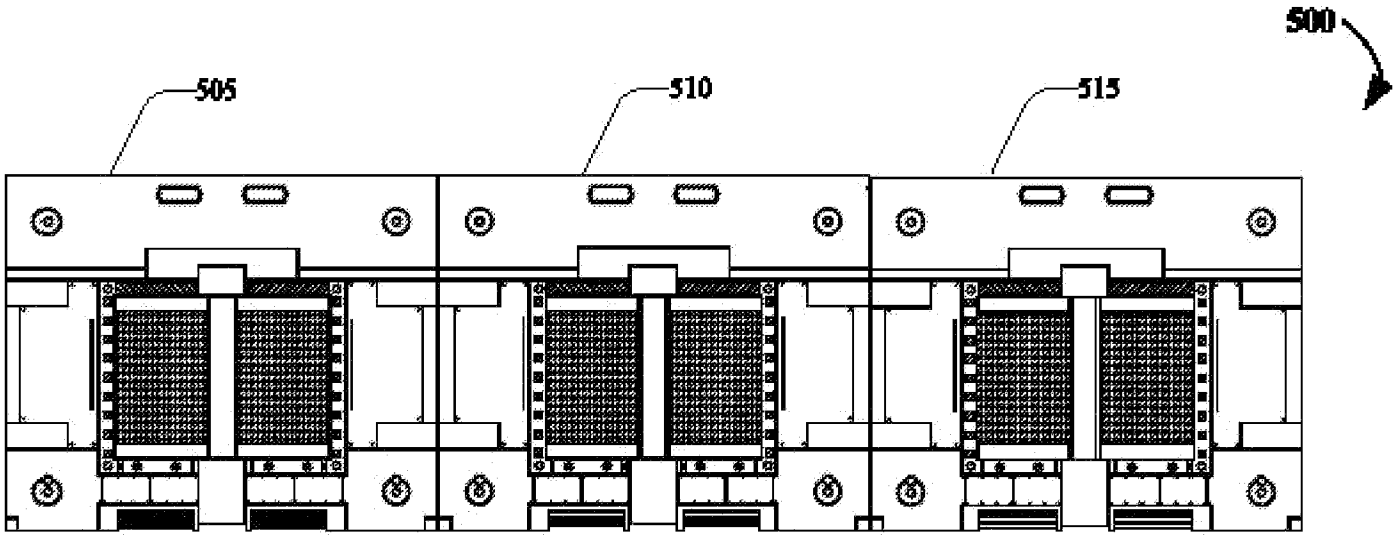
FIG. 5 illustrates a plurality of connected display plates in accordance with the present disclosure.

FIG. 5 illustrates a plurality of connected display plates 500 in accordance with the present disclosure. In particular, FIG. 5 describes a first display plate 505 and a second display plate 510 that may be connected to each other. Similarly, a third display plate 515 may be connected to the second display plate 510. In some aspect, each display plate (the first display plate 505, the second display plate 510, and the third display plate 515) may include the integrated plate connector sockets, as described above (not shown in FIG. 5).

The plurality of display plates 500 may be interconnected via the connector/coupler 415 as described in FIG. 4.

Although FIG. 4 and FIG. 5 indicate two or three display plates, a person ordinary skill in the art may appreciate that there may be more number of display plates that may be connected to each other, based on the display item/model size and type.

Figure 6:
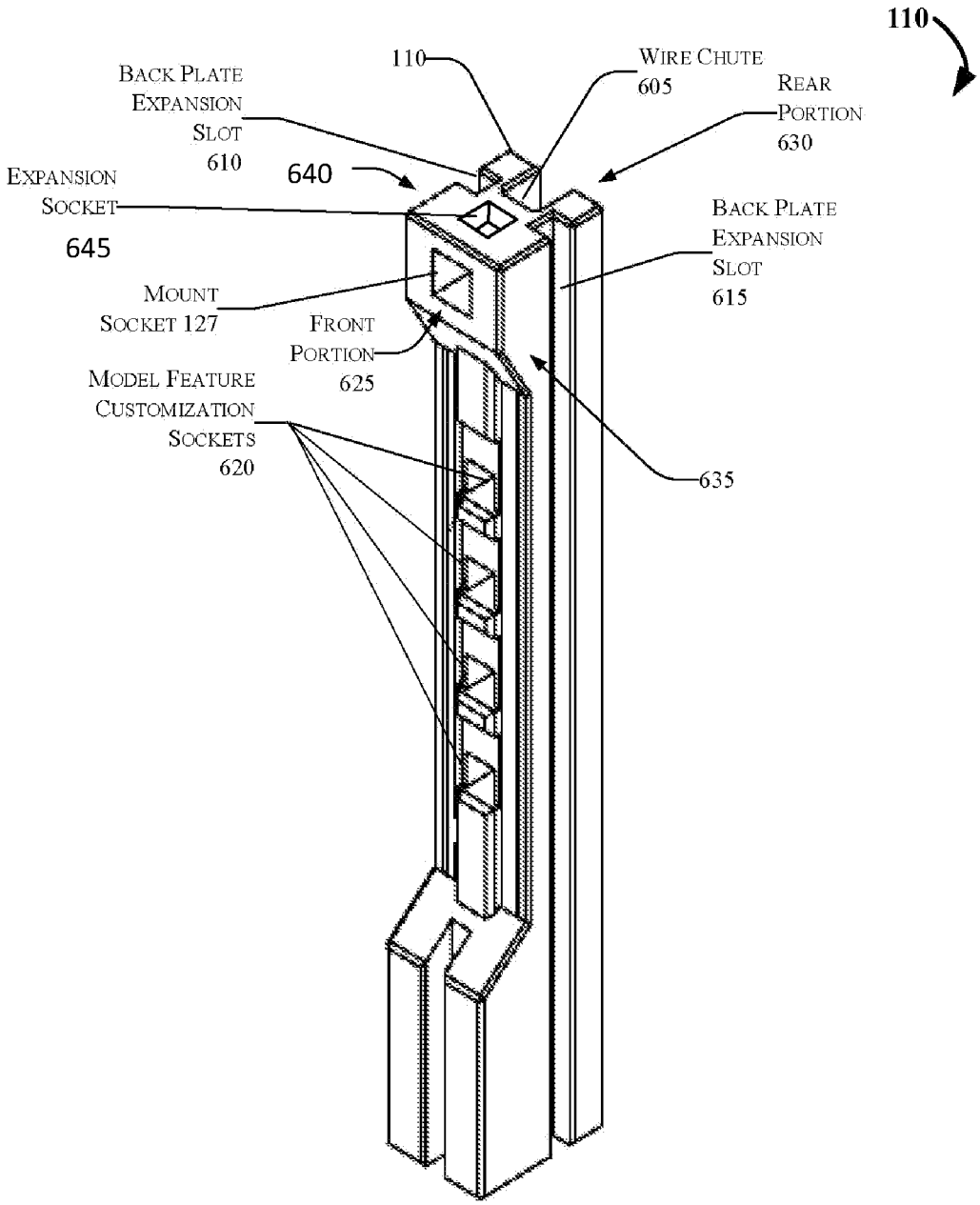
FIG. 6 depicts a rear vertical structural member in accordance with the present disclosure.

FIG. 6 depicts a rear vertical structural member in accordance with the present disclosure. The vertical structure member may be same as the first and second rear vertical members 110. Hereinafter, the rear vertical structural member is referred to as the rear vertical structural member 110.

As discussed in conjunction with FIG. 1, the rear vertical structural member 110 may be removably disposed on the proximal base plate side. In some aspects, the rear vertical structural member 110 may include a wire chute 605 for holding or managing wires.

The rear vertical structural member 110 may further include an inner back plate expansion slot 610 and an outer back plate expansion slot 615 (same as the inside back plate expansion slot and the outside back plate expansion slot, described in FIG. 1). The inner back plate expansion slot 610 and the outer back plate expansion slot 615 may be opposite to each other. In some aspects, the inner back plate expansion slot 610 and/or the outer back plate expansion slot 615 may be configured to receive and hold the back plate 130. In one or more aspects, an inner back plate expansion slot of a first rear vertical structural member and an outer back plate expansion slot of a second rear vertical structural member may be configured to hold/position the back plate 130.

In further aspects, the wall-mounted display case system 100 may be customized and expanded by adding a second back plate between an outer back plate expansion slot of the first rear vertical structural member and an expansion slot of a third rear vertical structural member.

The rear vertical structural member 110 may further include a plurality of modular feature customization sockets 620 configured to removable attach a plurality of components (such as the catwalk 160 and/or other platforms or accessories) at different heights between the rear vertical member set and the front vertical member set. In some aspects, the first and second front vertical members 120 may include corresponding sockets (similar to the plurality of modular feature customization sockets 620) to attach the plurality of components.

Furthermore, the rear vertical structural member 110 may have a front portion 625, which may include the mount socket 170. The mount socket 170 may be configured to removably connect the horizontal side beam member 115 between the rear vertical structural member 110 and the corresponding front rear vertical structural member (e.g., first and second front vertical members 120). In some aspects, the front rear vertical structural member may have corresponding sockets, similar to the mount socket 170, configured to attach the horizontal side beam member 115. In one or more aspects, the mount socket 170 may be positioned above the plurality of modular feature customization sockets 620.

The rear vertical structural member 110 may further have a rear portion 630 in which the wire chute 605 may be carved/present and an outer portion 635 in which the outer back plate expansion slot 615 may be present. In addition, the rear vertical structural member 110 may include an inner portion 640 in which the inner back plate expansion slot 610 may be present. The rear vertical structural member 110 may further include a top portion on which an expansion socket 645 may be present. The expansion socket 645 may be configured to removably attach another rear vertical structural member (not shown) on the rear vertical structural member top and customize the wall-mounted display case system height. In some aspects, the other rear vertical structural member may attach with the expansion socket 645 by using an expansion module associated with the other rear vertical structural member. In some aspects, the other rear vertical structural member may include a second level model display surface. In this manner, the wall-mounted display case system 100 may be configured to display multiple items at different display surface levels.

Figure 7:
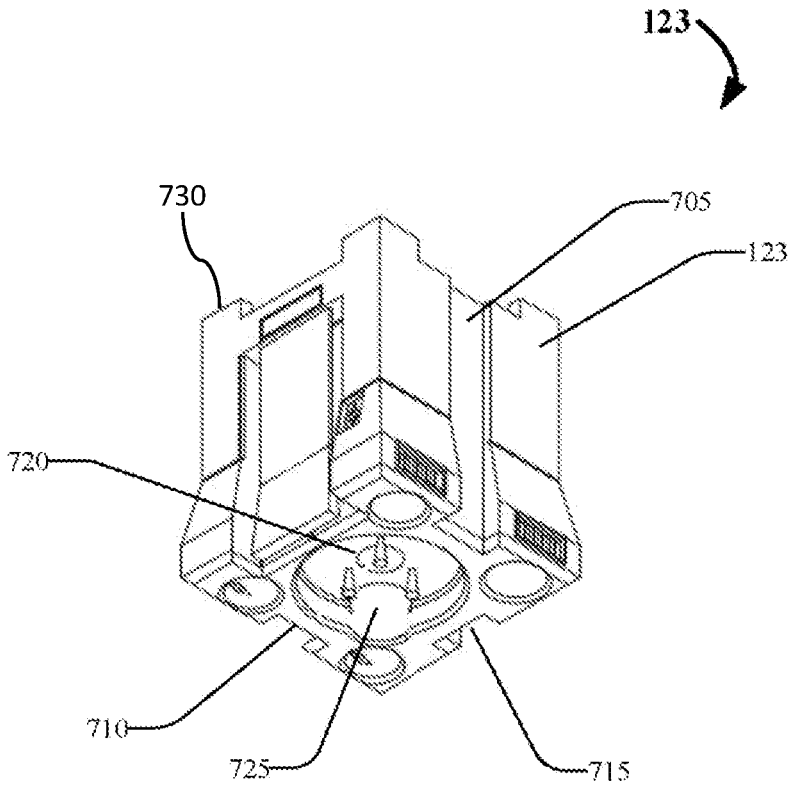
FIG. 7 depicts a front vertical member base in accordance with the present disclosure.

FIG. 7 depicts the front vertical member base 123 in accordance with the present disclosure. As discussed above, the front vertical member base 123 may be part of the first and second front vertical members 120. In some aspects, the front vertical member base 123 may allow the wall-mounted display case system height customization.

The front vertical member base 123 may include an outer slot 705, an inner slot 710 and a rear slot 715 that may be configured to removably engage with additional wall-mounted display case system components (e.g., accessories, wires, additional platforms, expansion components, etc.).

The front vertical member base 123 may further include a bottom portion 720. The bottom portion 720 may include a first attachment means 725 that may be configured to connect to the base plate 105 via the front vertical member attachment holes 210. In particular, the first attachment means 725 may include a set of protrusions or screws that may fit in the front vertical member attachment holes 210. The set of protrusions or screws may be placed in any order (in a triangular shape or a linear shape). In some aspects, the first attachment means 725 may connect with the front vertical member attachment holes 210 via a connector (not shown), that may be cylindrical in shape. One side of the connector may be inserted into the first attachment means 725, and the second side may be inserted into the front vertical member attachment holes 210.

In some aspects, the bottom portion 720 may also include a wire chute and/or other additional components (not shown).

In further aspects, the front vertical member base 123 may include a top portion 730 that comprises a second attachment means (not shown in FIG. 7) to connect the front vertical member base 123 with the front vertical member 120. In some aspects, the second attachment means may include recess to receive the front vertical member 120.

Figure 8:
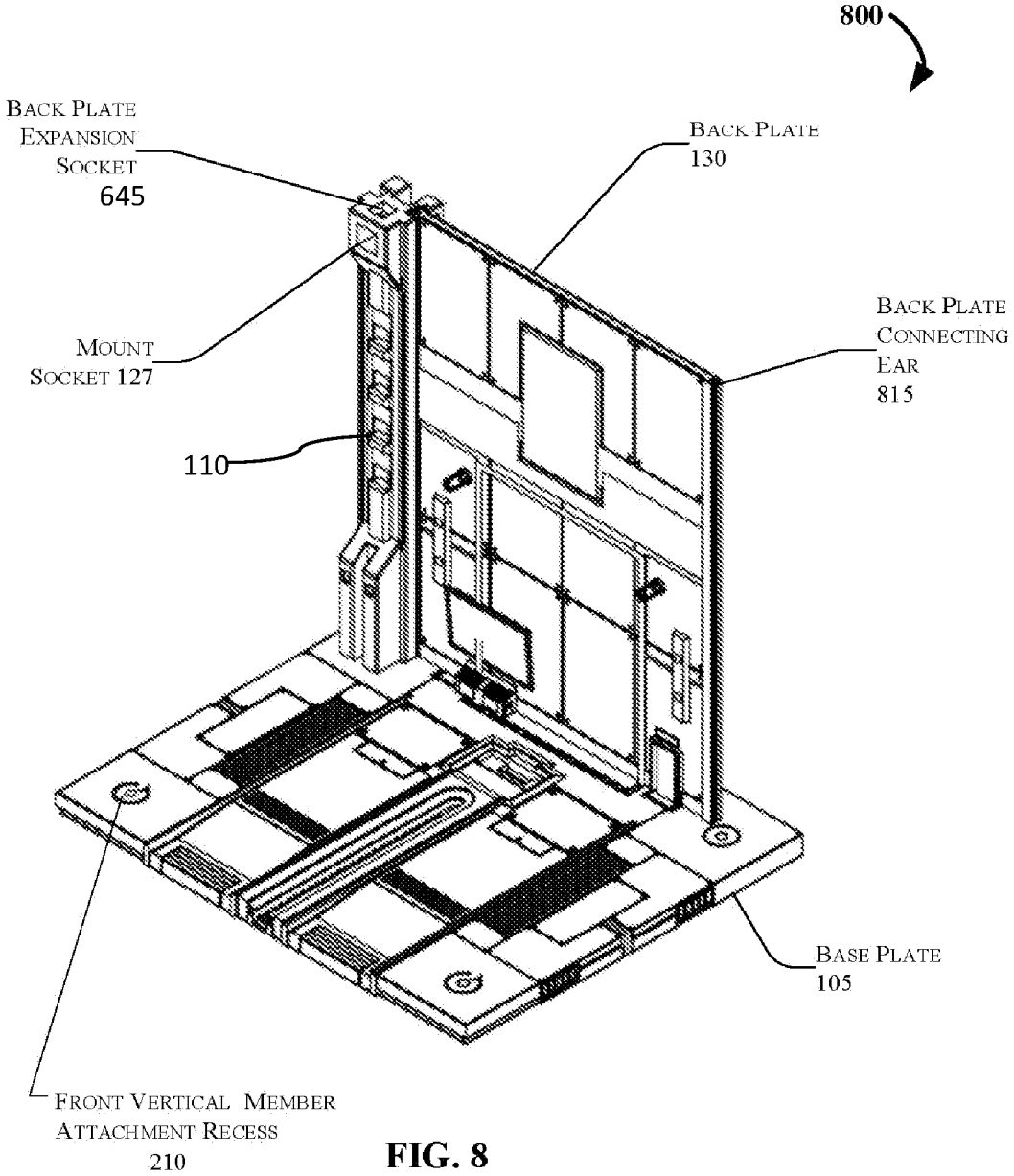
FIG. 8 illustrates a partial assembly of a rear vertical structural member, a display plate, and a back connecting plate in accordance with the present disclosure.

FIG. 8 illustrates a partial assembly 800 of the rear vertical structural member 110, the display plate 200, and a back connecting plate (e.g., the back plate 130) in accordance with the present disclosure. As discussed above, the display plate 200 may include the base plate 105. The base plate 105 may include the rear vertical member attachment holes/recesses 205 (not shown in FIG. 8) and the front vertical member attachment holes/recesses 210. The rear vertical structural member 110 may be removably attached to the base plate 105 via the rear vertical member attachment holes 205. Similarly, the front vertical member attachment holes/recesses 210 may be configured to removably attach the base plate 105 to the first and second front vertical members 120 (not shown in FIG. 8).

In some aspects, the back plate 130 may include a pair of back connecting ears 815. The pair of back connecting ears 815 may be present at back plate left and right edges. The rear vertical structural member 110 may be configured to insert inside the pair of back connecting ears 815, through the inner back plate expansion slot 610 and/or the outer back plate expansion slot 615 (not shown in FIG. 8). The back connecting ear thickness may correspond to the thickness associated with the inner back plate expansion slot 610 and/or the outer back plate expansion slot 615.

As described above, the back plate 130 may be customized based on display item/model type. In further aspects, the back plate 130 may be configured to slide between two rear vertical structural members (e.g., the first and second rear vertical members 110). As discussed above, the rear vertical structural member 110 may include the expansion socket 645 (or back plate expansion socket) and the mount socket 170 to removably connect the rear vertical structural member 110 with additional components (e.g., another rear vertical structural member and the horizontal side beam member 115), as described in conjunction with above figures.

Figure 9:
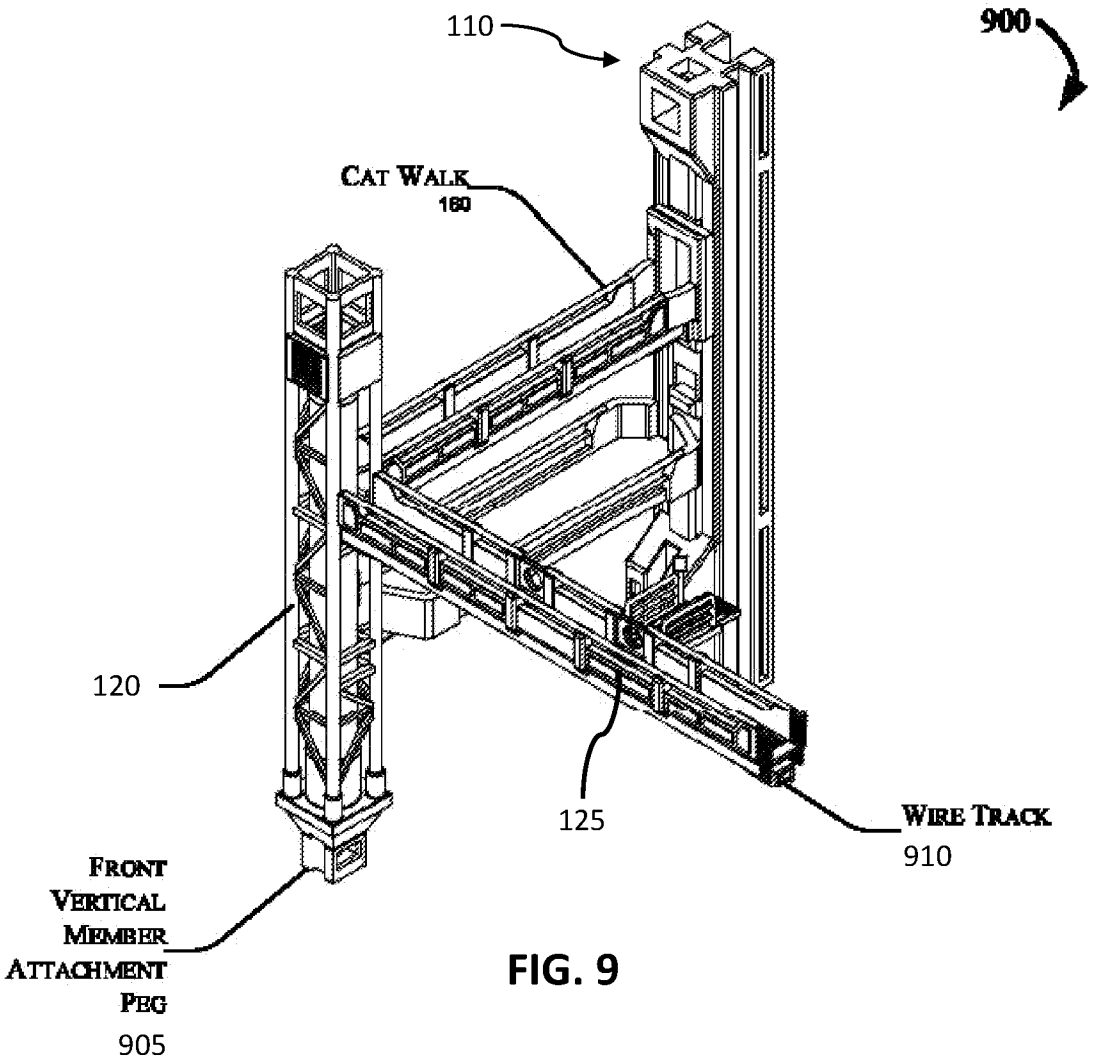
FIG. 9 depicts a display skywalk system disposed in connection with a front vertical member and a rear vertical member in accordance with the present disclosure.

FIG. 9 depicts a display skywalk system 900 disposed in connection with a front vertical member (e.g., the first front vertical member 120) and a rear vertical member (e.g., the first rear vertical member 110) in accordance with the present disclosure. In particular, FIG. 9 depicts the catwalk 160 that may be removably disposed between the first front vertical member 120 and the first rear vertical member 110. As described above, the catwalk 160 may be removably attached to the modular feature customization sockets 620 present in the first rear vertical member 110, and corresponding sockets present in the first front vertical member 120.

In further aspects, the first front vertical member 120 may include a front vertical member attachment peg 905, at a front vertical member distal end portion. Specifically, the front vertical member attachment peg 905 may be disposed at the distal end of the front vertical member upright body portion 165. The front vertical member attachment peg 905 may be configured to removably attach to the front vertical member base 123, which may be attached to the base plate 105 as described above. The front vertical member attachment peg structure may correspond to the front vertical member base structure. In particular, the front vertical member base 123 may include holes or recesses that may be configured to receive the front vertical member attachment peg 905.

In addition, FIG. 9 depicts the horizontal front beam member 125 that may be connected with the first front vertical member 120. In some aspects, the horizontal front beam member 125 may include a wire track 910. The wire track 910 may be configured to manage wires in the wall-mounted display case system 100, e.g., the wires that may pass through the horizontal front beam member 125.

Figure 10:
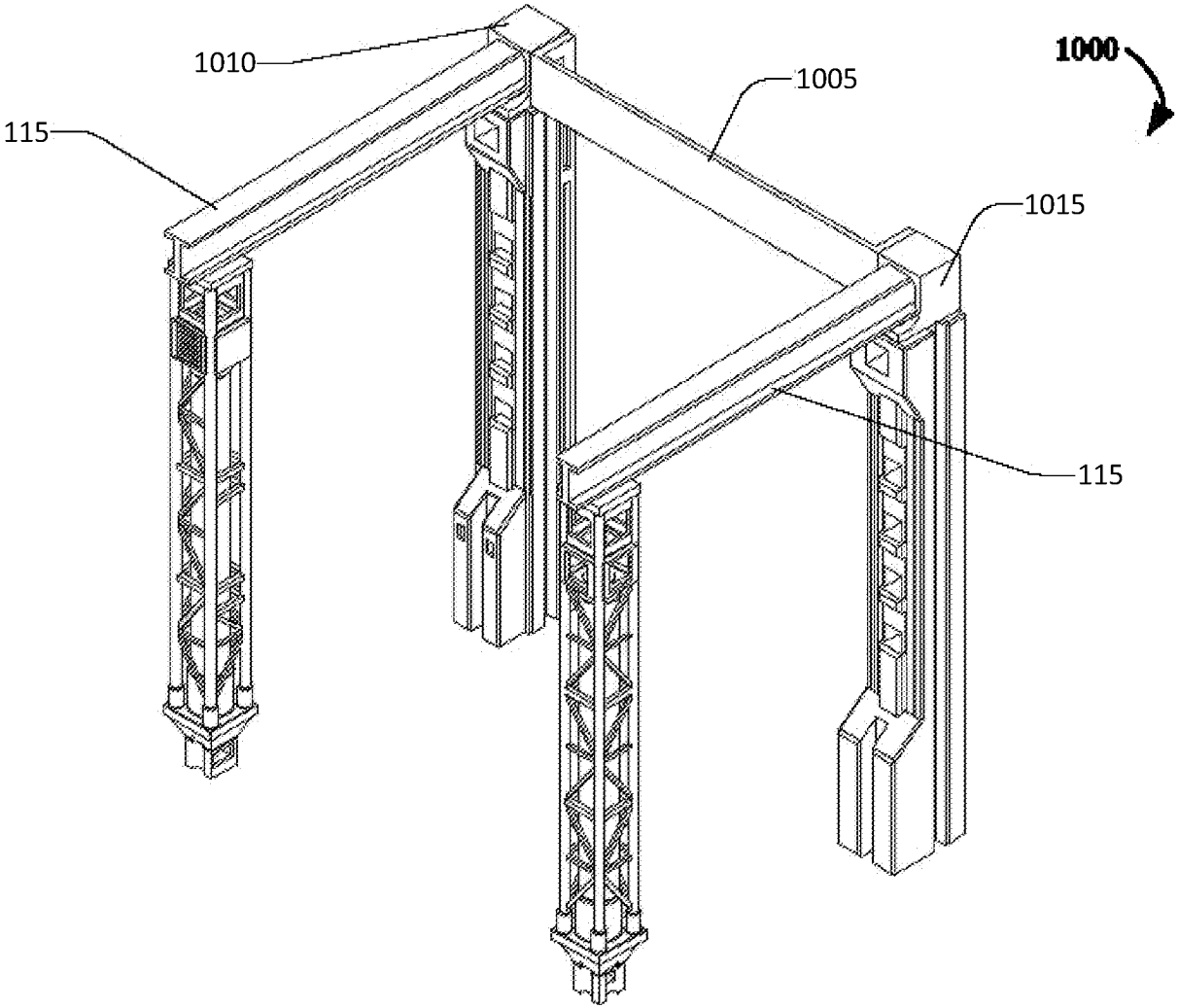
FIG. 10 illustrates front vertical members and rear vertical members connecting a horizontal rear beam member in accordance with the present disclosure.

FIG. 10 illustrates the front vertical members 120 and the rear vertical members 110 connecting a horizontal rear beam member 1005 in accordance with the present disclosure, as indicated as 1000 in FIG. 10. In particular, FIG. 10 depicts a first connector 1010 and a second connector 1015, which are removably attached to the rear vertical members 110 through the expansion socket 645. In other words, the first connector 1010 and the second connector 1015 may be inserted in the expansion socket 645. In some aspects, the first connector attributes (e.g., dimensions or size) may be same as the second connector attributes. In further aspects, the first connector 1010 and the second connector 1015 may be made of same material (or different material) as the front vertical members 120 and/or the rear vertical members 110. In particular, the first connector 1010 and the second connector 1015 may be made of plastic, aluminum, steel or other similar material.

In further aspects, the horizontal rear beam member 1005 may be removably disposed between the first connector 1010 and the second connector 1015. In other words, the horizontal rear beam member 1005 may be removably disposed between the rear vertical members 110, via the first connector 1010 and the second connector 1015. The horizontal rear beam member 1005 may be configured to provide addition rigidity and support to the wall-mounted display case system 100. The horizontal rear beam member 1005 may further provide support to a second level display that be attached above the rear vertical members 110. In some aspects, the horizontal rear beam member 1005 may have same or different attributes as the attributes associated with the horizontal front beam member 125 and the first horizontal side beam member 115.

Figure 11B:
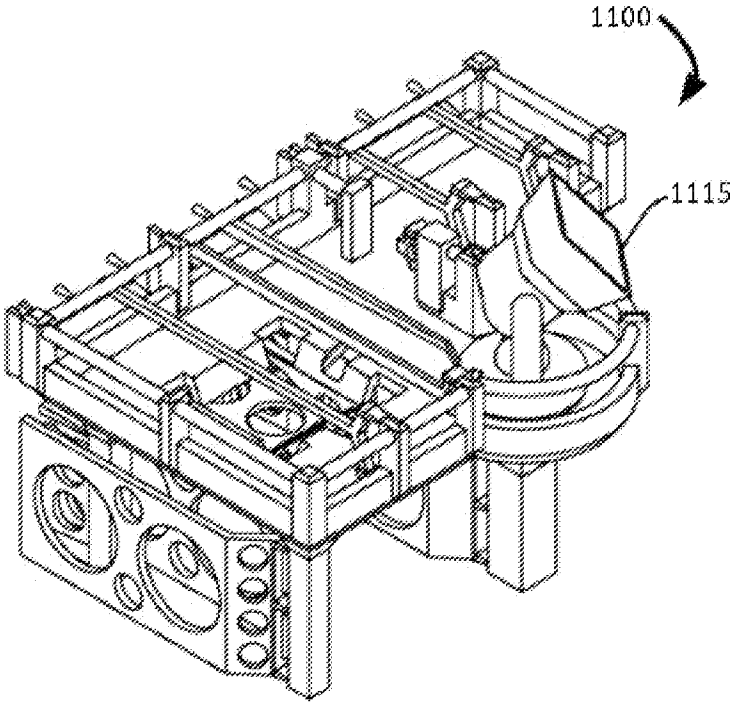
FIG. 11B depicts the platform of FIG. 11A with an interchangeable light emitting diode (LED) display lamp in accordance with the present disclosure.
Figure 11A:
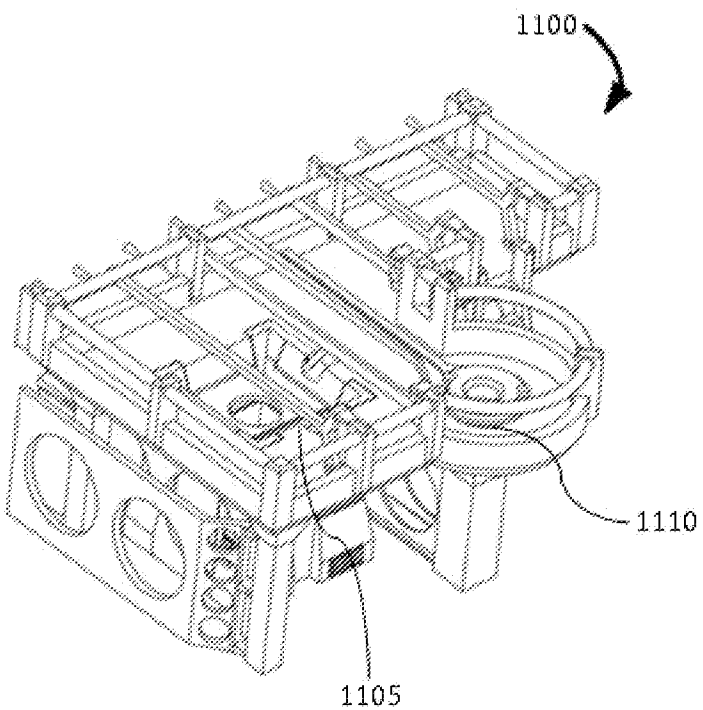
FIG. 11A illustrates a platform connectable to the skywalk system of FIG. 9 according to embodiments described herein.

FIG. 11A illustrates a platform 1100 connectable to the skywalk system 900 of FIG. 9 according to embodiments described herein. In some aspects, the platform 1100 may be configured to removably connect with the catwalk 160, the front vertical members 120, the rear vertical members 110, the horizontal side beam member set, and/or the horizontal front beam member 125. In some aspects, the platform 1100 may be configured to mount accessories and/or to support other wall-mounted display case system components.

In one or more aspects, the platform 1100 may be removably connected to the front vertical member base 123. In further aspects, the platform 1100 may be integrated to the front vertical member base 123.

In some aspects, the platform 1100 may include an attachment recess 1105 configured to receive the front vertical members 120 (e.g., via the front vertical member attachment peg 905) and/or the front vertical member base 123. In further aspects, a plurality of platforms may be arranged at various locations on the wall-mounted display case system 100.

In further aspects, the platform 1100 may include a base (or legs) that may be removably coupled to the base plate 105. In some aspects, the platform 1100 may be of any shape, e.g., square, rectangular, circular, and the like. In one or more aspects, the platform 1100 may be as shown in FIG. 11A. For instance, the platform 1100 may include an arc portion 1110, on which any accessory (such as a light emitting diode (LED)) may be mounted.

FIG. 11B depicts the platform 1100 of FIG. 11A with an interchangeable light emitting diode (LED) display lamp 1115 in accordance with the present disclosure. The LED display lamp 1115 may be configured to illuminate the display item/model that may be placed on the wall-mounted display case system 100. In some aspects, the LED display lamp may include an attachment means to removably affix in a recess present in the arc portion 1110. In further aspects, the LED display lamp 1115 may be connected to a power source (not shown) via wires, which may illuminate the LED display lamp 1115.

Figure 11C:
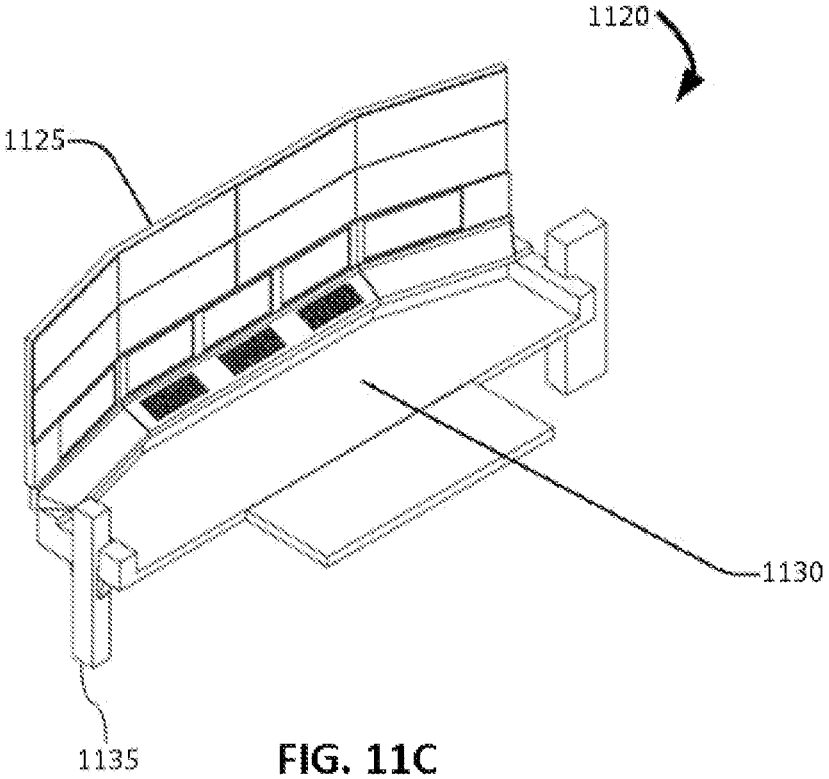
FIG. 11C illustrates another example platform connectable to the skywalk system of FIG. 9 according to embodiments of the present disclosure.

FIG. 11C illustrates another example platform 1120 connectable to the skywalk system 900 of FIG. 9 according to embodiments of the present disclosure. In some aspects, the platform 1120 may be configured to removably connect with the catwalk 160, the front vertical members 120, the rear vertical members 110, the horizontal side beam member set, and/or the horizontal front beam member 125. In some aspects, the platform 1120 may be configured to mount accessories and/or to support other wall-mounted display case system components. In some aspects, the platform 1120 may be of any shape, including, rectangle, oval, square, arc, and the like.

In further aspects, the platform 1120 may include a wall 1125 that may be straight or curved, as shown in FIG. 11C. In some aspects, the platform 1120 may include a support surface 1130 that may be arranged perpendicular to the wall 1125. In some aspects, the support surface 1130 may be coupled to a base 1135 that may be removably affixed to the base plate 105 (and specifically on the display mount surface) or slidably affixed to the outer slot 705, the inner slot 710 or the rear slot 715. The support surface 1130 may be configured to place the wall-mounted display case system accessories (e.g., LEDs, miniature action figures, and/or the like).

Figure 12:
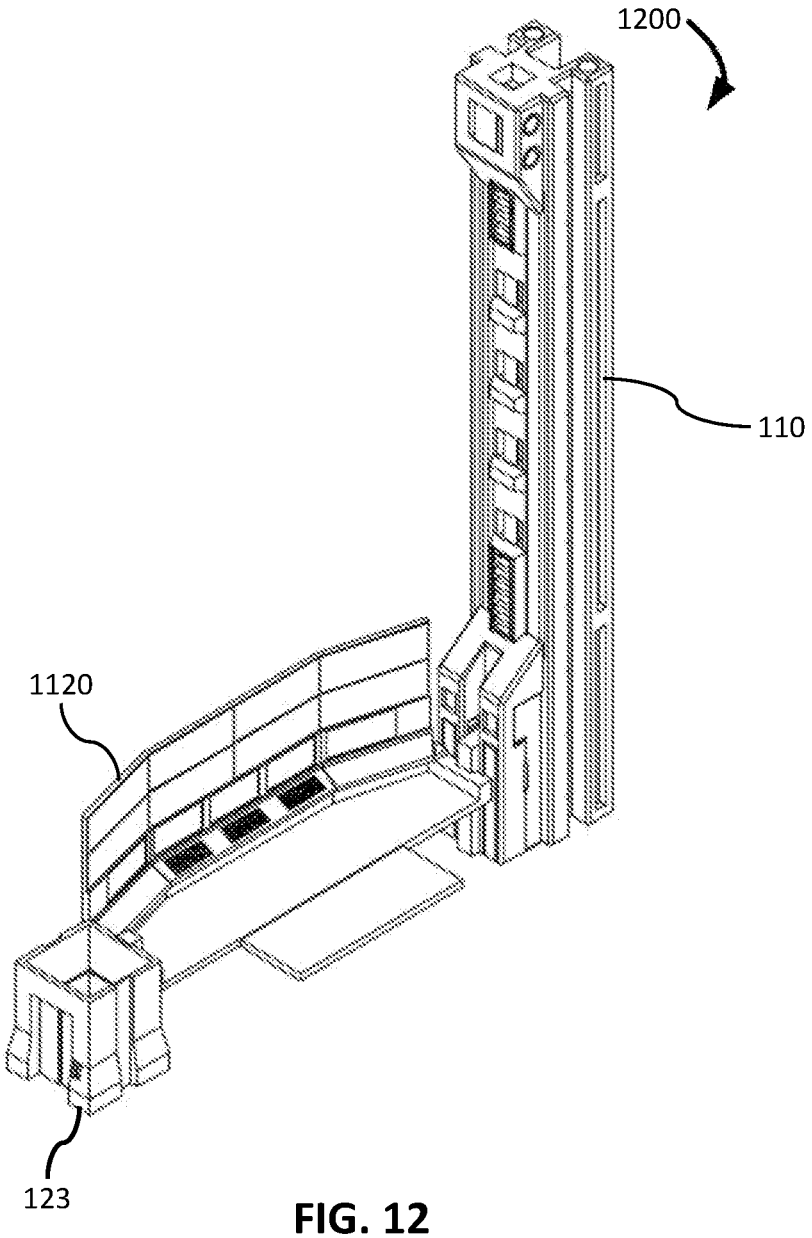
FIG. 12 depicts a rear vertical member and a front vertical member base connecting the platform of FIG. 11C in accordance with the present disclosure.

FIG. 12 depicts a rear vertical member and the front vertical member base 123 connecting the platform 1120 of FIG. 11C in accordance with the present disclosure, as indicated as 1200. The rear vertical member may be, for example, the first rear vertical member 110.

In some aspects, the platform 1120 may extend between the first rear vertical member 110 and the front vertical member base 123 (associated with the first front vertical member 120). More specifically, the base 1135 (indicated in FIG. 11C) may be inserted into a rear vertical member slot at one end, and into a front vertical member slot (or front vertical member base slot) at another end. In some aspects, the base 1135 dimensions may correspond to the rear vertical member slot and the front vertical member slot dimensions. In one or more aspects, the wall-mounted display case system 100 may include a plurality of platforms (which may be similar to the platform 1120) without departing from the scope of patent disclosure.

Figure 13:
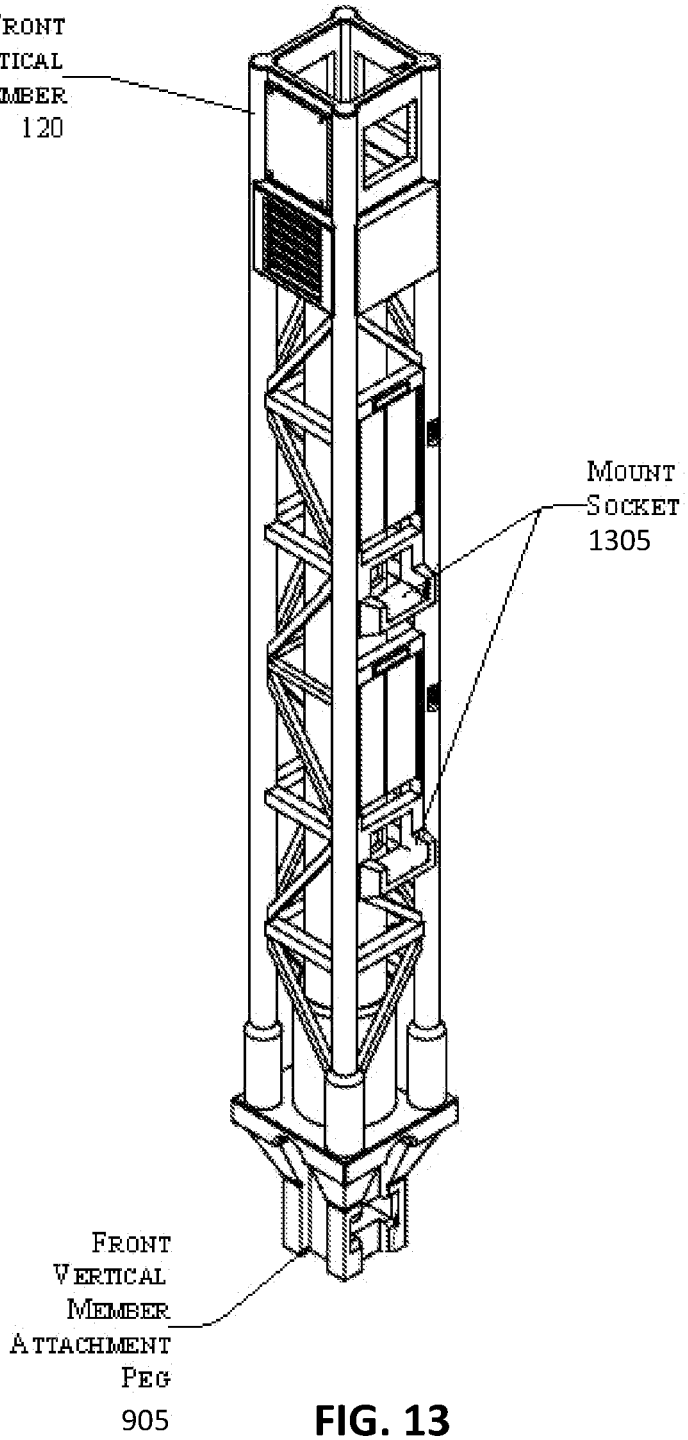
FIG. 13 illustrates a front vertical member in accordance with the present disclosure.

FIG. 13 illustrates a front vertical member in accordance with the present disclosure. In some aspects, the front vertical member may be the first front vertical member 120. As discussed in conjunction with FIG. 1, the wall-mounted display case system 100 may include two front vertical members that may be removably disposed on the proximal base plate side. The first front vertical member 120 may include the front vertical member attachment peg 905, at the first front vertical member end portion. The front vertical member attachment peg 905 may be configured to removably attach to the front vertical member base 123, which may be attached to the base plate 105. The front vertical member attachment peg structure may correspond to the front vertical member base structure. For example, the front vertical member base 123 may include holes or recesses that may be configured to receive the front vertical member attachment peg 905.

In some aspects, the first front vertical member 120 may include a plurality of mount sockets 1305. In some aspects, the plurality of mount sockets 1305 may be configured to mount one or more wall-mounted display case system components, including, the catwalk 160 and/or other similar platforms.

In further aspects, the first (and second) front vertical member 120 may be configured to connect with another front vertical member set (not shown) at a first (and second) front vertical member top end. Specifically, the other front vertical member set may be connected to the front vertical member upright body portion 165, configured to add another layer of front vertical members to the wall-mounted display case system 100.

Figure 14:
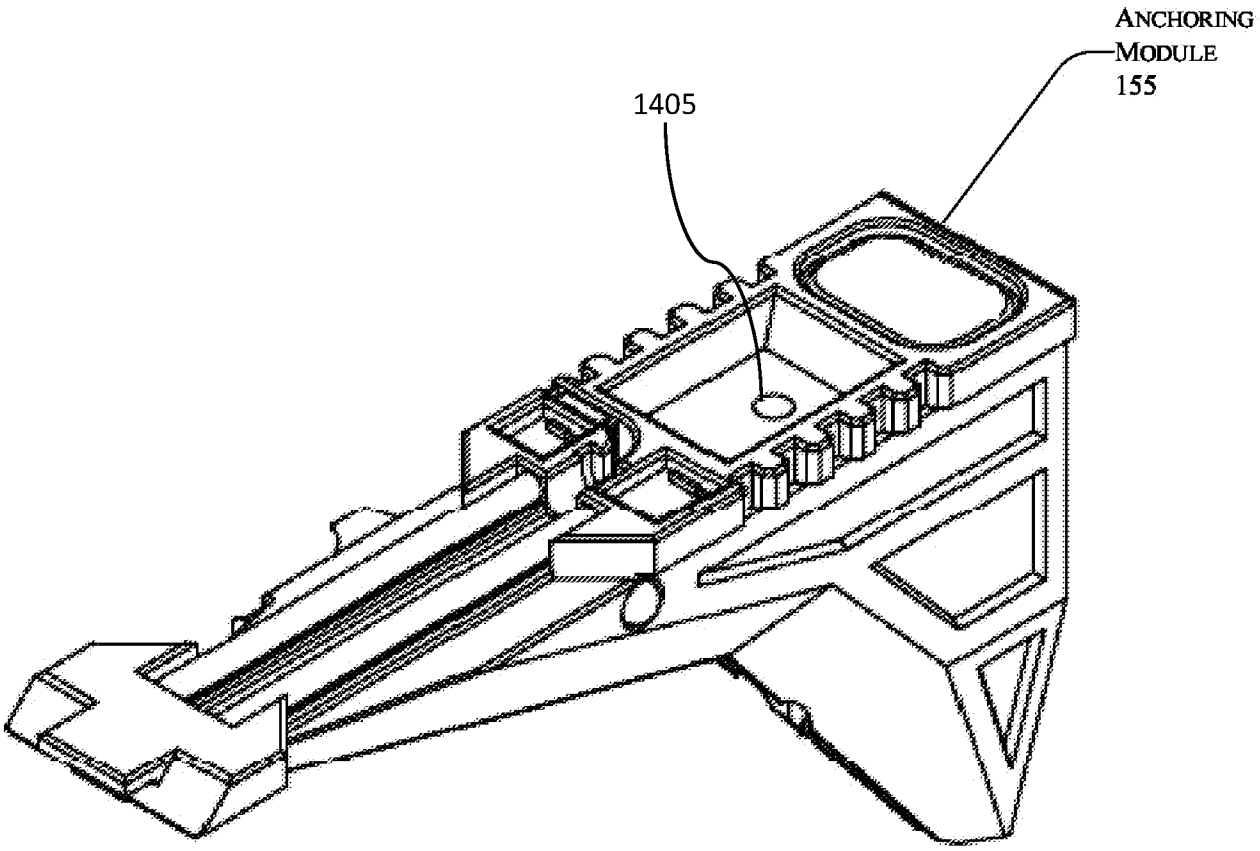
FIG. 14 illustrates a front outside view of an anchor module in accordance with the present disclosure.

FIG. 14 illustrates a front outside view of an anchor module 155 (or the wall anchoring system 155) in accordance with the present disclosure. As discussed above, the anchor module 155 may be configured to mount the wall-mounted display case system 100 on a vertical wall. In particular, the anchor module 155 may include a removable rear locking surface (at an anchor module rear side, not shown in FIG. 14) configured to removably attach to a wall mountable bracket cleat set (not shown in FIG. 14).

In some aspects, the anchor module 155 may made of plastic. In other aspects, the anchor module 155 may be made of steel, aluminum, or similar metals.

The anchor module 155 may include a top anchor recess 1405 that may be configured to attach to the square nut socket 315 and dispose the display plate 300 on the anchor module 155. In this manner, the wall-mounted display case system 100 may be attached to the anchor module 155, which itself may be removably attached to the vertical wall by using the removable rear locking surface and the wall mountable bracket cleat set.

Figure 15:
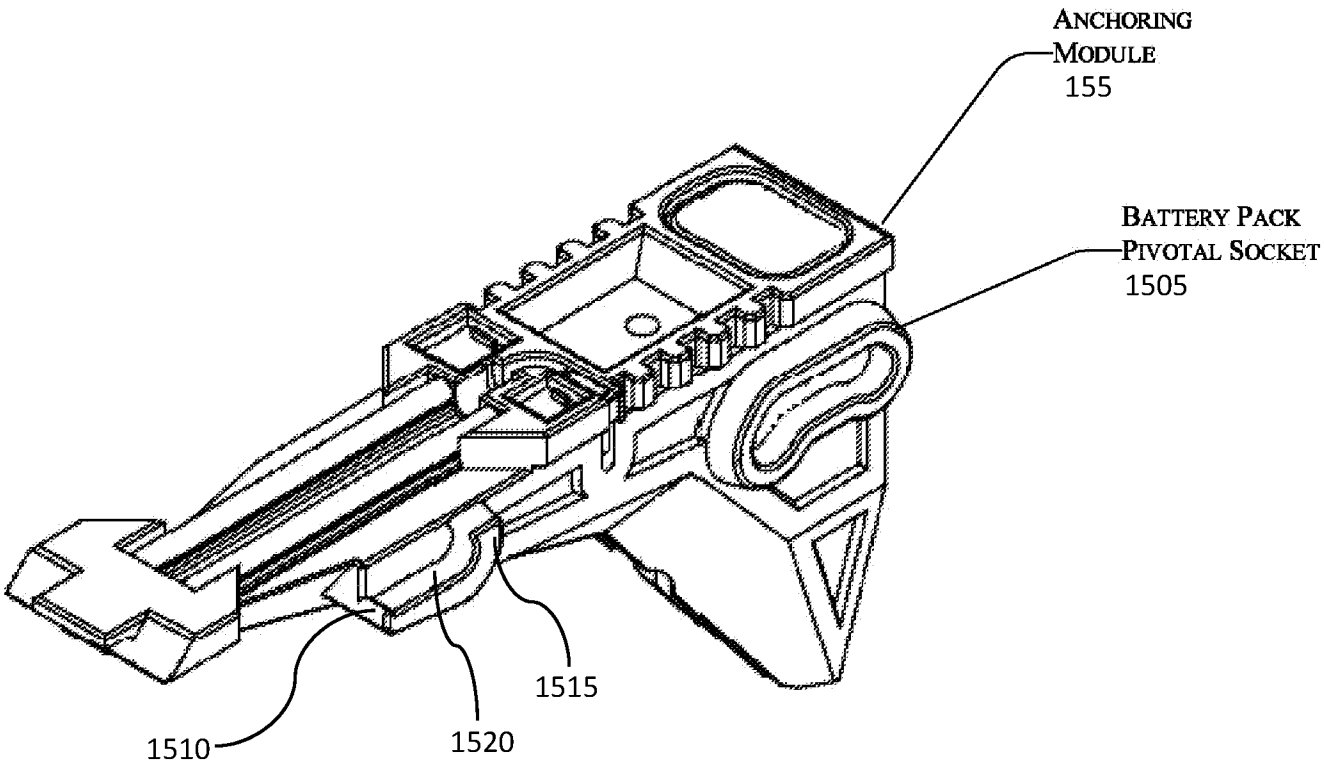
FIG. 15 illustrates a front inside view of the anchor module of FIG. 14 in accordance with the present disclosure.

FIG. 15 illustrates a front inside view of the anchor module 155 of FIG. 14 in accordance with the present disclosure. In some aspects, the anchor module 155 may include a battery pack pivotal connector socket 1505 at an anchor module inner side. The battery pack pivotal connector socket 1505 may be located on a proximal anchor module side (or an inner side, as shown in FIG. 15). In some aspects, the battery pack pivotal connector socket 1505 may be located at an anchor module rear end (e.g., towards the wall or the wall mountable bracket cleat set). In further aspects, the battery pack pivotal connector socket 1505 may be configured to pivotally attach to a battery storage compartment (not shown in FIG. 15). In one or more aspects, the battery pack pivotal connector socket 1505 may be configured to pivotally attach to a battery storage compartment rear end.

The anchor module 155 may further include a locking surface 1510 on the proximal anchor module side. In particular, the locking surface 1510 may be located at an anchor module front end (e.g., at an anchor module end opposite to the battery pack pivotal connector socket 1505). In some aspects, the locking surface 1510 may be configured to lock a battery storage compartment front end. In some aspects, the locking surface 1510 may be configured to lock the battery storage compartment in a locked position. Specifically, the locking surface 1510 may be configured to engage with the battery storage compartment in the locked position and disengage with the battery storage compartment in an unlocked position (discussed in conjunction with FIG. 18). In further aspects, the locking surface 1510 may be closed at one end, and open at another end, as shown in FIG. 15. The locking surface 1510 may include a curved vertical portion 1515 at a locking surface rear end (or an anchor module distal wall-facing side), and may include a flat horizontal elongated portion 1520 that may be disposed perpendicular to the curved vertical portion 1515. One end of the flat horizontal elongated portion 1520 may be open, and the other end may be connected to the curved vertical portion 1515. The vertical portion may be configured to lock the battery storage compartment and the horizontal elongated portion may be configured to unlock the battery storage compartment. In some aspects, the locking surface 1510 may have a unitary structure. In further aspects, the locking surface 1510 may be integrated to the anchor module 155.

Figure 16:
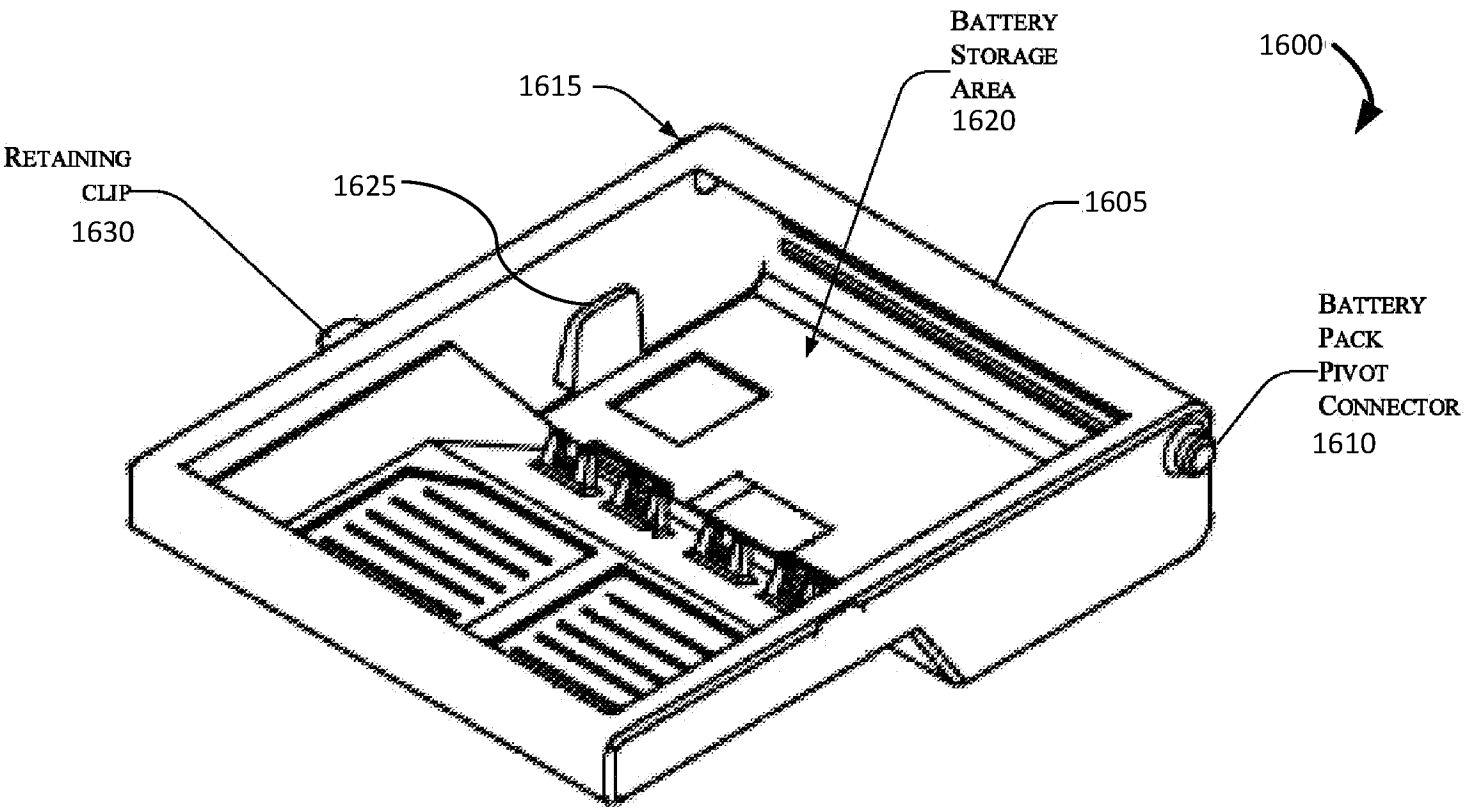
FIG. 16 depicts a top view of a battery storage compartment in accordance with embodiments of the present disclosure.

FIG. 16 depicts a top view 1600 of a battery storage compartment 1605 in accordance with embodiments of the present disclosure. In some aspects, the battery storage compartment 1605 may be pivotally attached to a pair/set of anchor modules (e.g., the anchor module 155).

The battery storage compartment 1605 may include a first battery pack pivot connector 1610 and a second battery pack pivot connector 1615, which are configured to attach the battery storage compartment 1605 to the anchor module set (e.g., a first wall anchor module and a second wall anchor module). In some aspects, the first wall anchor module attributes (e.g., dimensions and shape) may be same as the second wall anchor module attributes. In further aspects, the first battery pack pivot connector 1610 and the second battery pack pivot connector 1615 may include a protrusion that may extend from the battery storage compartment 1605. In some aspects, the protrusion may be threaded and configured to insert inside the battery pack pivotal connector socket 1505 associated with each anchor module.

The battery storage compartment 1605 may further include a battery storage area 1620 that may be configured to hold the power source or batteries (as described above, not shown in FIG. 16) that provide electric power to the wall-mounted display case system accessories, e.g., the LEDs. In some aspects, the battery storage area 1620 may include a cavity or recess that may securely hold the power source in the battery storage compartment 1605. In one or more aspects, the battery storage compartment 1605 may include teeth 1625 to secure the power source to the battery storage area 1620 and prevent power storage fall from the battery storage area 1620 (e.g., when the battery storage compartment 1605 is in the unlocked position).

In further aspects, the battery storage compartment 1605 may include one or more retaining clips 1630. The retaining clips 1630 may be configured to engage with the locking surface 1510. Specifically, the retaining clips 1630 may engage with the curved vertical portion 1515 when the battery storage compartment 1605 is in the locked position and may be configured to slide through the flat horizontal elongated portion 1520 to disengage the battery storage compartment 1605 to the unlocked position, via the flat horizontal elongated portion open end. In particular, to pivotally open the battery storage compartment 1605 (e.g., to change the position from locked to unlocked state), the battery storage compartment 1605 may be made to move from the anchor module distal wall-facing side to a front portion of an anchor module proximal side. When the battery storage compartment 1605 moves, the retaining clips 1630 disengage from the locking surface 1510 (e.g., by horizontally sliding through the flat horizontal elongated portion open end), and may then pivotally rotate from a planarly tangent position respective to the base plate 105 to a generally perpendicular position respective to the base plate 105.

Figure 17:
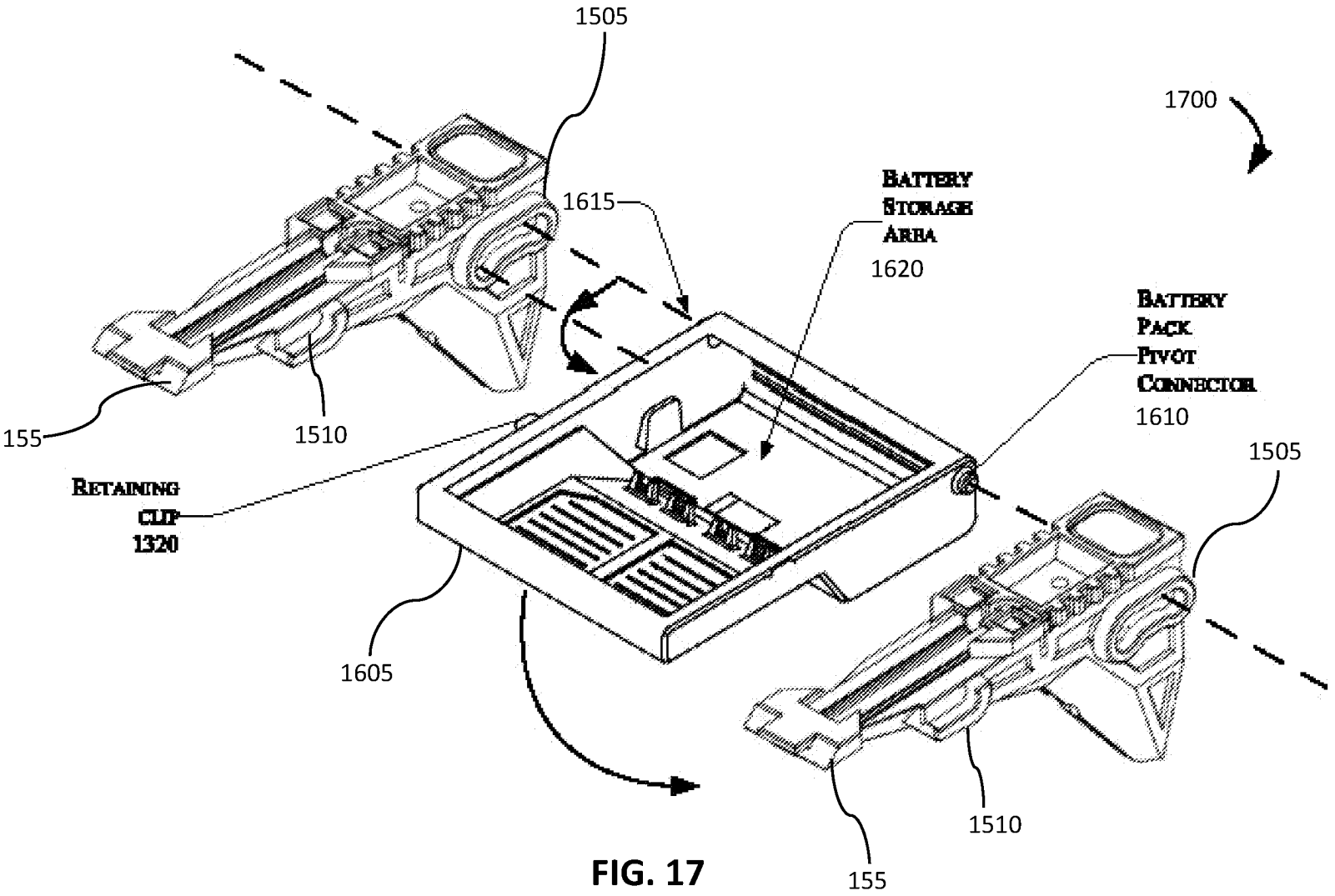
FIG. 17 illustrates a plurality of anchor modules aligned for assembly with the battery storage compartment in accordance with the present disclosure.

FIG. 17 illustrates a plurality of anchor modules (e.g., the anchor module 155) aligned for assembly with the battery storage compartment 1605 in accordance with the present disclosure, as indicated as 1700. As described above, the battery storage compartment 1605 may include the first battery pack pivot connector 1610 and the second battery pack pivot connector 1615. The first battery pack pivot connector 1610 and the second battery pack pivot connector 1615 may be configured to insert inside the battery pack pivotal connector socket 1505 and pivotally attach the battery storage compartment 1605 to the plurality of anchor modules 155. In some aspects, the plurality of anchor modules 155 may be aligned to the battery storage compartment 1605 such that the first battery pack pivot connector 1610 and the second battery pack pivot connector 1615 may be inserted inside the respective battery pack pivotal connector sockets (associated with the plurality of anchor modules 155). Specifically, the plurality of anchor modules 155 may be aligned in an "opposing" arrangement, such that a battery pack pivot connector socket of a first anchor module may face the battery pack pivot connector socket of a second anchor module. Similarly, the first anchor module locking surface (e.g., the locking surface 1510) may face the second anchor module locking surface. The battery storage compartment 1605 may be configured to pivotally attach between the first and second anchor modules, by using the respective battery pack pivot connector sockets 1505 and the locking surfaces 1510.

To explain further, the plurality of anchor modules 155 may include a first battery pack pivot connector socket (e.g., the battery pack pivotal connector socket 1505) on a first anchor module proximal side and a second battery pack pivot connector socket (not shown) on a second anchor module distal side. In addition, the plurality of anchor modules 155 may include a first locking surface (e.g., the locking surface 1510) on the first anchor module proximal side and a second locking surface (not shown) on the second anchor module distal side.

As described above, by sliding horizontally the battery storage compartment 1605 via the respective first and second anchor modules' locking surfaces (specifically via the flat horizontal elongated portion 1520), the battery storage compartment 1605 may be pivotally rotated to be in an unlocked state from a locked state. In some aspects, an access to the battery storage area 1620 may be provided by rotating the battery storage compartment 1605 from the locked state to the unlocked state.

In some aspect, the battery storage compartment 1605 may be disposed perpendicular to the vertical wall and parallel or planar to the base plate 105 (as described above) in the locked state, and may be parallel to the vertical wall and perpendicular to the base plate 105 in the unlocked state.

Figure 18:
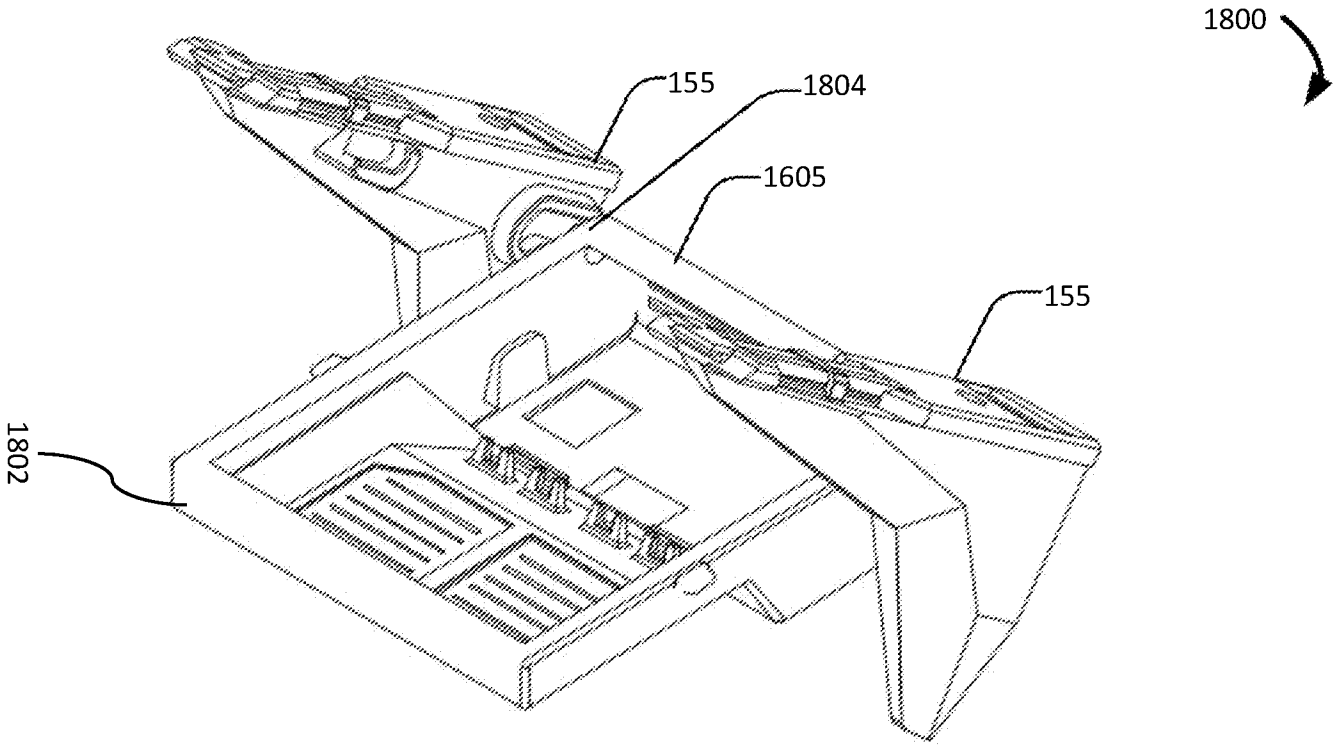
FIG. 18 illustrates the plurality of anchor modules assembled with the battery storage compartment in accordance with the present disclosure.

FIG. 18 illustrates the plurality of anchor modules 155 assembled with the battery storage compartment 1605 in accordance with the present disclosure, as indicated as 1800. In particular, FIG. 18 depicts an open position in which one end 1802 of the battery storage compartment 1605 is disengaged from the plurality of anchor modules 155, and another end 1804 is pivotally connected to the plurality of anchor modules 155 via the battery pack pivotal connector socket 1505. As described above, the battery storage compartment 1605 may be configured to pivotally rotate, e.g., between the locked and unlocked positions.

In some aspects, the battery storage compartment 1605 may slide from the locked position to the unlocked position, and pivotally rotate on a pivotal axis that provides access to an interior battery portion in the battery storage area 1620.

Figure 19C:
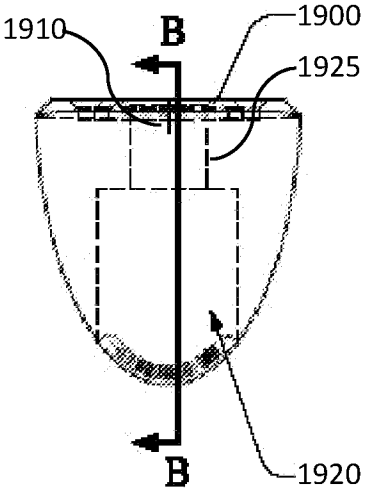
FIG. 19C illustrates a top view of the wall mounting bracket cleat of FIG. 19A in accordance with the present disclosure.
Figure 19B:
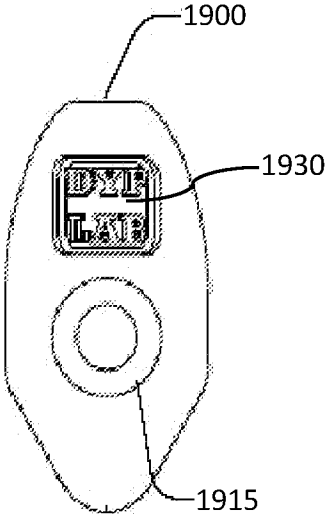
FIG. 19B illustrates a front view of the wall mounting bracket cleat of FIG. 19A in accordance with the present disclosure.
Figure 19A:
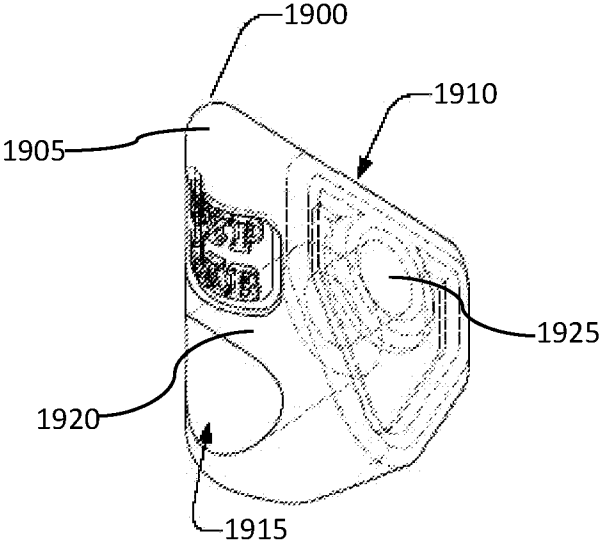
FIG. 19A depicts an angle view of a wall mounting bracket cleat in accordance with the present disclosure.

FIG. 19A depicts an angle view of a wall mounting bracket cleat 1900 in accordance with the present disclosure. The wall mounting bracket cleat 1900 may have a front surface 1905 and a rear surface 1910. The rear surface 1910 may be configured to attach to the vertical wall to affix the wall mounting bracket cleat 1900 on the vertical wall.

In some aspects, the wall mounting bracket cleat 1900 may be mounted to the wall via a fastener, adhesive and/or the like. The wall mounting bracket cleat 1900 may include an elongated cavity 1915, which may enable wall mounting bracket cleat attachment to the vertical wall via the fastener. In one or more aspects, the elongate cavity 1915 may include a first portion 1920 and a second portion 1925. A first portion length and diameter may be greater than a second length and diameter. The first portion and second portion dimensions may correspond to fastener dimensions that may be used to affix the wall mounting bracket cleat 1900 to the vertical wall.

In some aspects, a wall mounting bracket cleat shape may correspond to a shape of a rear anchor recess (not shown) in an anchor module rear portion. The wall mounting bracket cleat 1900 may be configured to insert inside the rear anchor recess to fix the wall-mounted display case system 100 on the vertical wall.

In further aspects, there may be a plurality of wall mounting bracket cleats configured to mount the plurality of anchor modules 155 on the vertical wall (to form a wall mounting system). In one or more aspects, the plurality of wall mounting bracket cleats may include a first bracket cleat and a second bracket cleat.

FIG. 19B illustrates a front view of the wall mounting bracket cleat 1900 of FIG. 19A in accordance with the present disclosure. The wall mounting bracket cleat 1900 may include a label 1930 (such as marketing logo) disposed on a wall mounting bracket cleat front side.

FIG. 19C illustrates a top view of the wall mounting bracket cleat 1900 of FIG. 19A in accordance with the present disclosure. As depicted in the top view, in one or more aspects, the wall mounting bracket cleat 1900 may have a semi-circular shape (or half-oval shape) along a wall mounting bracket cleat length. In other aspects, the wall mounting bracket cleat 1900 may have different shapes (e.g. square or rectangular), as seen from the top view.

Figure 19D:
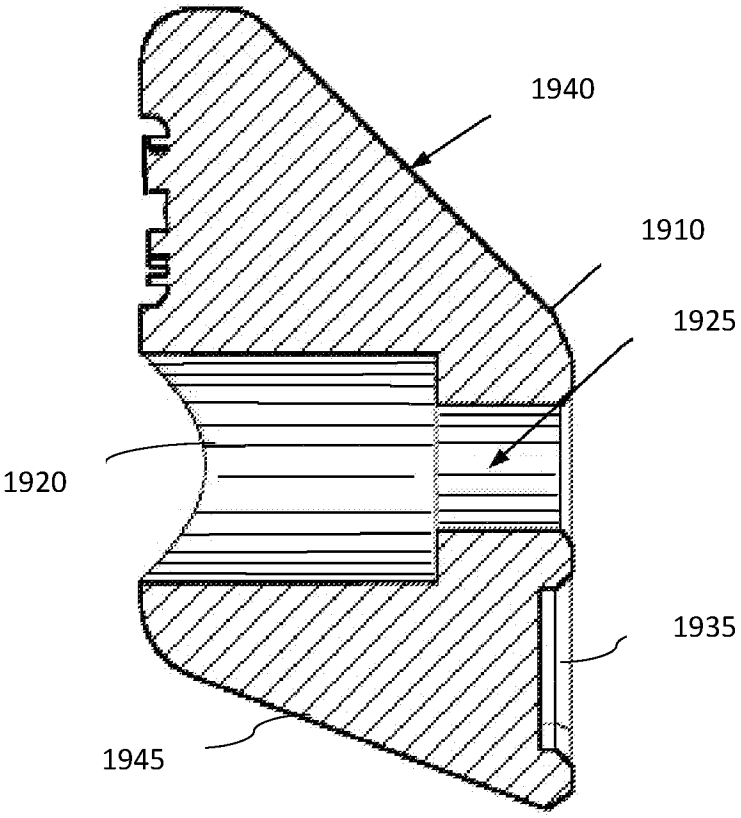
FIG. 19D illustrates a section view B-B of the wall mounting bracket cleat of FIG. 19A in accordance with the present disclosure.

FIG. 19D illustrates a section view B-B of the wall mounting bracket cleat 1900 of FIG. 19A in accordance with the present disclosure. The rear surface 1910 may include a first portion 1935 and a second portion 1940. The first portion 1935 may affix with the vertical wall (e.g., via the fastener) and the second portion 1940 may be slanted away from the wall at a first predefined angle. In some aspects, the second portion 1940 may receive the rear anchor recess that may enable the anchor module 155 (and correspondingly the wall-mounted display case system 100) to affix to the wall.

In further aspects, the wall mounting bracket cleat 1900 may include a bottom surface 1945. The bottom surface 1945 may be slanted at a second predefined angle. In some aspects, the first predefined angle may be different from the second predefined angle. In other aspects, the second predefined angle may be same as the first predefined angle.

Figure 20:
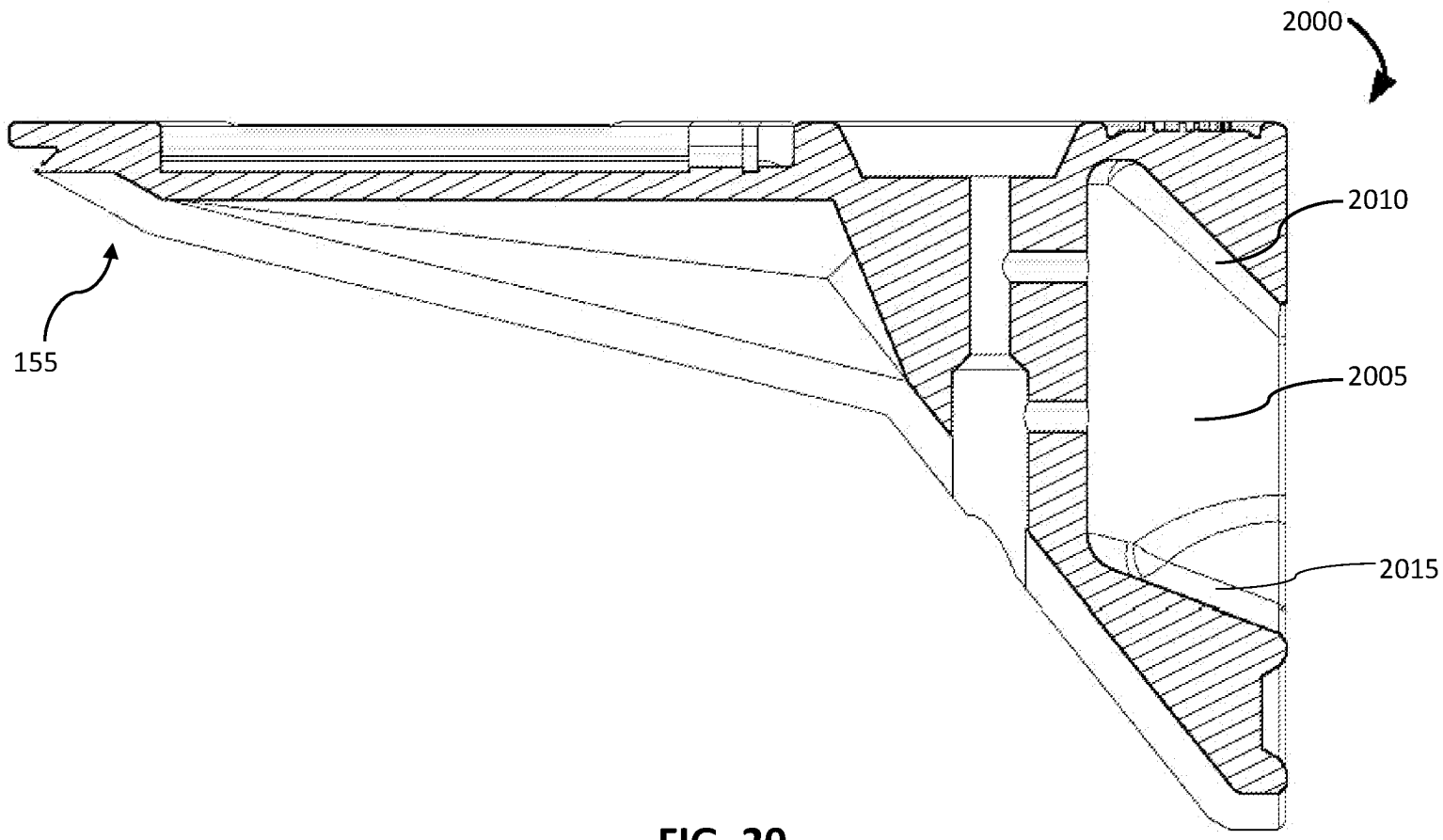
FIG. 20 illustrates a section view C-B of the anchor module of FIG. 14 in accordance with the present disclosure.

FIG. 20 illustrates a section view C-B of the anchor module 155 of FIG. 14 in accordance with the present disclosure, as indicated as 2000. The anchor module 155 may include a rear anchor recess 2005 that may be configured to insert (or receive) the second portion 1940 to removably attach the anchor module 155 to the wall mounting bracket cleat 1900. Specifically, a slanted proximal portion 2010 of the rear anchor recess 2005 may rest on the second portion 1940 to secure the rear anchor recess 2005 on the wall mounting bracket cleat 1900. A person ordinarily skilled in the art may appreciate that a second portion shape complements the slanted proximal portion shape. In further aspects, the proximal portion 2010 may be slanted at the first predefined angle. In some aspects, the slanted proximal portion 2010 (and correspondingly the second portion 1940) may be slanted at an angle of 45 degrees from the vertical wall.

In some aspects, the second portion and the slanted proximal portion shapes may be different from the shapes shown in FIGS. 19D and 20, respectively. For example, the slanted proximal portion 2010 may be "L-shaped" to receive a correspondingly shaped second portion 1940. In other aspects, the slanted proximal portion 2010 may be slanted at an angle different from 45 degrees.

In further aspects, the rear anchor recess 2005 may include a slanted distal portion 2015 that may be attached to the bottom surface 1945. In some aspects, the distal portion 2015 may be slanted at the second predefined angle.

Figure 21:
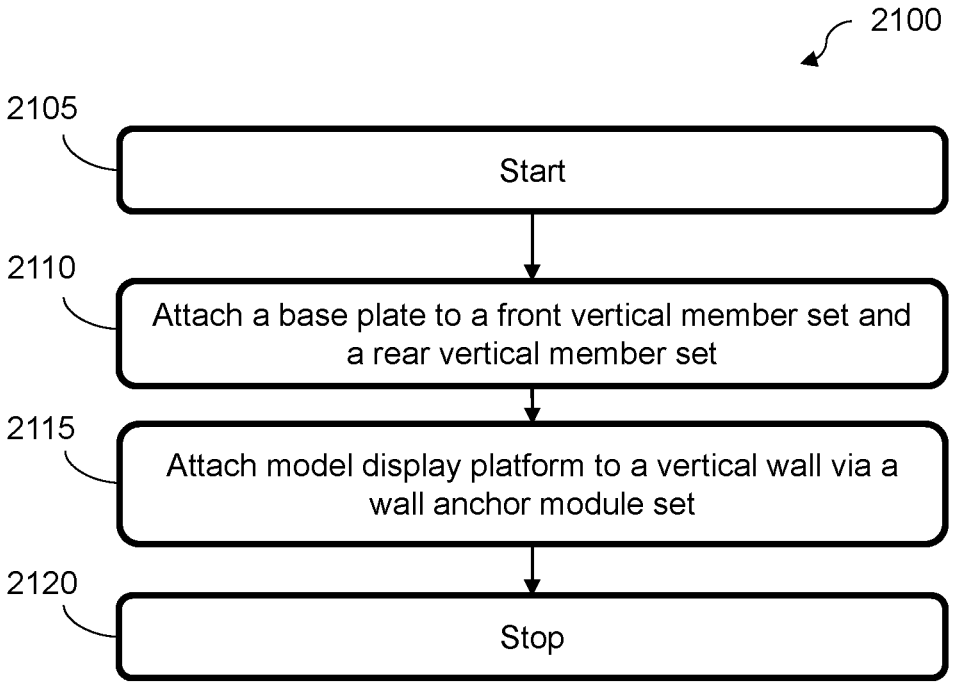
FIG. 21 depicts a flow diagram of a method for displaying an item using the system of FIG. 1 according to embodiments of the present disclosure.

FIG. 21 is a flow diagram of an example method 2100 for displaying an object on a model display platform, according to the present disclosure. The model display platform may be, for example, the wall-mounted display case system 100. FIG. 21 may be described with continued reference to prior figures, including FIGS. 1-20. The following process is exemplary and not confined to the steps described hereafter. Moreover, alternative embodiments may include more or less steps that are shown or described herein and may include these steps in a different order than the order described in the following example embodiments.

Referring first to FIG. 21, at step 2105, the method 2100 may commence. At step 2110, the method 2100 may include attaching the base plate 105 to the front vertical member set and the rear vertical member set. As described above, the front vertical member set may include the first and second front vertical members 120, and the rear vertical member set may include the first and second rear vertical members 110.

As described in conjunction with FIG. 1, the base plate 105 may include the model display surface on the proximal base plate side and the display mounting surface on the distal base plate side. The step 2110 may include attaching the base plate 105 to the front vertical member set, which may be removably disposed on the proximal base plate side.

According to other aspects, the step 2110 may further include removably attaching the rear vertical member set to the proximal base plate side, removably attaching the horizontal side beam set with the front vertical member set and the rear vertical member set, and removably attaching the horizontal front beam member 125 by connecting it with the front vertical member set. As described above, the horizontal side beam set may include the first horizontal side beam member 115 and the second horizontal side beam member (not shown).

At step 2115, the method 2100 may include attaching the model display platform to a vertical wall via a wall anchor module set (e.g., a pair of anchor modules, such as the anchor module 155) rigidly disposed to the display mounting surface on the distal base plate side. As described above, the anchor module 155 may include a removable rear locking surface (e.g., the rear anchor recess 2005) configured to removably attach to a wall mountable bracket cleat set (e.g., the wall mounting bracket cleat 1900).

The step 2115 may include, optionally, attaching multiple display sets together laterally to extend the surface area of the wall-mounted display case system 100. For example, the wall-mounted display case system 100 described herein may be connectable to any number of additional sets to create a longer wall-mounted display.

At step 2120, the method 2100 may end.

In the above disclosure, reference has been made to the accompanying drawings, which form a part hereof, which illustrate specific implementations in which the present disclosure may be practiced. It is understood that other implementations may be utilized, and structural changes may be made without departing from the scope of the present disclosure. References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a feature, structure, or characteristic is described in connection with an embodiment, one skilled in the art will recognize such feature, structure, or characteristic in connection with other embodiments whether or not explicitly described.

It should also be understood that the word "example" as used herein is intended to be non-exclusionary and non-limiting in nature. More particularly, the word "example" as used herein indicates one among several examples, and it should be understood that no undue emphasis or preference is being directed to the particular example being described.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating various embodiments and should in no way be construed so as to limit the claims.

Accordingly, it is to be understood that the above description is intended to be illustrative and not restrictive. Many embodiments and applications other than the examples provided would be apparent upon reading the above description. The scope should be determined, not with reference to the above description, but should instead be determined with reference to the appended claims, along with the full scope of equivalents to which such claims are entitled. It is anticipated and intended those future developments will occur in the technologies discussed herein, and that the disclosed systems and methods will be incorporated into such future embodiments. In sum, it should be understood that the application is capable of modification and variation.

All terms used in the claims are intended to be given their ordinary meanings as understood by those knowledgeable in the technologies described herein unless an explicit indication to the contrary is made herein. In particular, use of the singular articles such as "a," "the," "said," etc. should be read to recite one or more of the indicated elements unless a claim recites an explicit limitation to the contrary. Conditional language, such as, among others, "can," "could," "might," or "may," unless specifically stated otherwise, or otherwise understood within the context as used, is generally intended to convey that certain embodiment could include, while other embodiments may not include, certain features, elements, and/or steps. Thus, such conditional language is not generally intended to imply that features, elements, and/or steps are in any way required for one or more embodiments.

That which is claimed is:

1. A wall mounting system, comprising:

a wall mountable bracket cleat having an upper rear cleat surface slanted at a first predetermined angle; and a wall anchor module configured to removably attach to the wall mountable bracket cleat, wherein the wall anchor module comprises:

a pivot connector socket on a wall anchor module side, wherein the pivot connector socket is configured to movably attach to a first object;

a locking surface on the wall anchor module side, wherein the locking surface is configured to lock the first object;

an anchor recess having an upper anchor recess surface configured to engage with the upper rear cleat surface, wherein the anchor recess is formed at a wall anchor module rear surface, and wherein the upper anchor recess surface is slanted at the first predetermined angle; and an attachment configured to attach the wall anchor module to a second object.

2. The wall mounting system of claim 1, wherein the wall mountable bracket cleat comprises a lower rear cleat surface slanted at a second predetermined angle.

3. The wall mounting system of claim 2, wherein the first predetermined angle is different from the second predetermined angle.

4. The wall mounting system of claim 3, wherein the anchor recess comprises a lower anchor recess surface slanted at the second predetermined angle.

5. The wall mounting system of claim 1, wherein the pivot connector socket is located at a wall anchor module rear end, and the locking surface is located at a wall anchor module front end.

6. The wall mounting system of claim 1, wherein the locking surface comprises a closed end and an open end to lock and unlock the first object.

7. The wall mounting system of claim 1, wherein the locking surface comprises a vertical portion and an elongated horizontal portion, and wherein the vertical portion is configured to lock the first object and the horizontal elongated portion is configured to unlock the first object.

8. The wall mounting system of claim 1, wherein the first object is a battery storage compartment.

9. The wall mounting system of claim 1, wherein the second object is a display plate.

10. The wall mounting system of claim 9, wherein the attachment comprises a square recess configured to receive a square nut socket of the display plate.

11. A wall mounting system, comprising:

a wall mountable bracket cleat set having a first bracket cleat and a second bracket cleat, wherein the first bracket cleat and the second bracket cleat have upper rear cleat surfaces slanted at a first predetermined angle; and a wall anchor module set configured to removably attach to the wall mountable bracket cleat set, wherein the wall anchor module set comprises:

opposing pivot connector sockets comprising:

a first pivot connector socket on a proximal anchor module side of a first anchor module of the wall anchor module set;

a second pivot connector socket on a distal anchor module side of a second anchor module of the wall anchor module set, wherein the first pivot connector socket and the second pivot connector socket are configured to movably attach to a first object;

opposing locking surfaces comprising:

a first locking surface on the proximal anchor module side of the first anchor module; and a second locking surface on the distal anchor module side of the second anchor module, wherein the first locking surface and the second locking surface are configured to lock the first object; and an anchor recess set having upper anchor recess surfaces configured to engage with the upper rear cleat surfaces, wherein the anchor recess set is formed at a wall anchor module set rear surface, and wherein the upper anchor recess surfaces are slanted at the first predetermined angle; and an attachment set configured to attach the wall anchor module set to a second object.

12. The wall mounting system of claim 11, wherein the wall mountable bracket cleat set comprises lower rear cleat surfaces slanted at a second predetermined angle.

13. The wall mounting system of claim 12, wherein the first predetermined angle is different from the second predetermined angle.

14. The wall mounting system of claim 12, wherein the anchor recess set comprise lower anchor recess surfaces slanted at the second predetermined angle.

15. The wall mounting system of claim 11, wherein the first pivot connector socket and the second pivot connector socket are located at a wall anchor module set rear end, and the first locking surface and the second locking surface are located at a wall anchor module set front end.

16. The wall mounting system of claim 11, wherein the first locking surface and the second locking surface comprise a closed end and an open end to lock and unlock the first object.

17. The wall mounting system of claim 11, wherein the first locking surface and the second locking surface comprise a vertical portion and an elongated horizontal portion, and wherein the vertical portion is configured to lock the first object and the horizontal elongated portion is configured to unlock the first object.

18. The wall mounting system of claim 11, wherein the first object is a battery storage compartment.

19. The wall mounting system of claim 11, wherein the second object is a display plate.

20. The wall mounting system of claim 19, wherein the attachment set comprises square recesses configured to receive square nut sockets of the display plate.

* * * * *